US009696682B2

(12) United States Patent
Hashimoto et al.

(10) Patent No.: US 9,696,682 B2
(45) Date of Patent: Jul. 4, 2017

(54) IMAGE FORMING APPARATUS AND DRUM UNIT WITH CONVEYING UNIT FOR CONVEYING TONER REMOVED FROM PHOTOSENSITIVE DRUM

(71) Applicant: Brother Kogyo Kabushiki Kaisha, Nagoya-shi, Aichi-ken (JP)

(72) Inventors: Junichi Hashimoto, Toyohashi (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/087,265

(22) Filed: Mar. 31, 2016

(65) Prior Publication Data

US 2016/0291527 A1 Oct. 6, 2016

(30) Foreign Application Priority Data

Mar. 31, 2015 (JP) ..... 2015-074251
Mar. 31, 2015 (JP) ..... 2015-074252

(51) Int. Cl.
*G03G 21/12* (2006.01)
*G03G 21/10* (2006.01)

(52) U.S. Cl.
CPC ... *G03G 21/105* (2013.01); *G03G 2215/0141* (2013.01)

(58) Field of Classification Search
CPC ..... G03G 21/10; G03G 21/105; G03G 21/12
USPC ..... 399/358, 360
See application file for complete search history.

(56) References Cited

U.S. PATENT DOCUMENTS 7,221,880 B2 * 5/2007 Jeong et al. ..... G03G 21/105 399/358
8,983,357 B2 * 3/2015 Sakashita et al. ... G03G 21/105 399/358

FOREIGN PATENT DOCUMENTS

JP 2010-008472 A 1/2010

* cited by examiner

*Primary Examiner* — William J Royer
(74) *Attorney, Agent, or Firm* — Banner & Witcoff, Ltd.

(57) ABSTRACT

An image forming apparatus, comprising: a body casing, a drum unit movable between an inside position and an outside position, and a waste toner storage unit, and wherein the drum unit comprises a photosensitive drum, a cleaning unit to remove toner remaining on a surface of the photosensitive drum, and a conveying unit including a conveying member to convey the toner in a moving direction of the drum unit, and a conveying tube to accommodate the conveying member and to have a discharging outlet through which the toner is discharged to the waste toner storage unit, and wherein the conveying tube comprises: a first conveying tube to extend in the moving direction and to accommodate the conveying member, and a second conveying tube to be connected to the first conveying tube and to extend in a direction intersecting with a direction in which the first conveying tube extends.

51 Claims, 11 Drawing Sheets

IMAGE FORMING APPARATUS AND DRUM UNIT WITH CONVEYING UNIT FOR CONVEYING TONER REMOVED FROM PHOTOSENSITIVE DRUM

CROSS-REFERENCE TO RELATED APPLICATION

This application claims priority under 35 U.S.C. §119 from Japanese Patent Applications No. 2015-074251, filed on Mar. 31, 2015 and No. 2015-074252, filed on Mar. 31, 2015. The entire subject matter of the applications is incorporated herein by reference.

BACKGROUND

Technical Field

The present disclosures relate to an electrophotographic type image forming apparatus and a drum unit mounted on the image forming apparatus.

Related Art

As an electrophotographic type image forming apparatus, a so-called tandem type image forming apparatus having photosensitive drums respectively corresponding to yellow, magenta, cyan and black is known.

One of image forming apparatuses of this type includes a plurality of process cartridges each of which supports a photosensitive drum and has a cleaning device for removing residual toner from the photosensitive drum, a frame supporting the plurality of process cartridges, and a waste toner conveying tube which conveys waste toner from the cleaning devices of the respective process cartridges to a waste toner storage box.

SUMMARY

In the above described image forming apparatus, the waste toner conveying tube is supported by the frame such that the waste toner conveying tube is connected to the plurality of process cartridges. Therefore, there is a drawback that the position of the waste toner conveying tube is limited, and toner cannot be discharged smoothly.

In consideration of the above, aspects of the disclosures provide at least one of an image forming apparatus and a drum unit capable of discharging toner smoothly and reliably.

According to an aspect of the disclosures, there is provided an image forming apparatus, comprising: a body casing; a drum unit configured to move between an inside position in the body casing and an outside position which is outside the body casing; and a waste toner storage unit configured to store toner. The drum unit comprises: a photosensitive drum; a cleaning unit configured to remove toner remaining on a surface of the photosensitive drum; and a conveying unit configured to convey the toner removed by the cleaning unit. In this configuration, the waste toner storage unit is configured to store the toner conveyed by the conveying unit. The conveying unit comprises: a conveying member configured to convey the toner removed by the cleaning unit in a moving direction of the drum unit; and a conveying tube accommodating the conveying member, the conveying tube having a discharging outlet through which the toner carried by the conveying member is discharged to the waste toner storage unit. The conveying tube comprises: a first conveying tube extending in the moving direction of the drum unit and accommodating the conveying member; and a second conveying tube connected to the first conveying tube and extending in a direction intersecting with a direction in which the first conveying tube extends.

According to another aspect of the disclosures, there is provided a drum unit, comprising: a first photosensitive drum; a second photosensitive drum; a first cleaning unit configured to remove toner remaining on a surface of the first photosensitive drum; a second cleaning unit configured to remove toner remaining on a surface of the second photosensitive drum; and a conveying unit configured to convey toner removed by the first cleaning unit and the second cleaning unit. The conveying unit comprises: a conveying member configured to convey the toner removed by the first cleaning unit and the second cleaning unit in an arranging direction in which the first photosensitive drum and the second photosensitive drum are arranged; and a conveying tube accommodating the conveying member, the conveying tube having a discharging outlet through which the toner carried by the conveying member is discharged to an outside. The conveying tube comprises: a first conveying tube extending in the arranging direction and accommodating the conveying member; and a second conveying tube connected to the first conveying tube and extending in a direction intersecting with a direction in which the first conveying tube extends.

According to another aspect of the disclosures, there is provided an image forming apparatus, comprising: a body casing; a drum unit configured to move between an inside position in the body casing and an outside position which is outside the body casing; and a waste toner storage unit configured to store toner. The drum unit comprises: a photosensitive drum; a cleaning unit configured to remove toner remaining on a surface of the photosensitive drum; and a conveying unit configured to convey the toner removed by the cleaning unit. In this configuration, the waste toner storage unit is configured to store the toner conveyed by the conveying unit. The conveying unit comprises: a first conveying member configured to rotate about a first axis extending in a moving direction of the drum unit and to convey the toner removed by the cleaning unit in a direction along the moving direction; a second conveying member configured to rotate about a second axis extending in the moving direction of the drum unit and to convey the toner conveyed by the first conveying member in a second direction opposite to the first direction; and a conveying tube accommodating the first conveying member and the second conveying member, the conveying tube having a discharging outlet through which the toner conveyed by the first conveying member and the second conveying member is discharged to the waste toner storage unit.

According to another aspect of the disclosures, there is provided a drum unit, comprising: a first photosensitive drum; a second photosensitive drum; a first cleaning unit configured to remove toner remaining on a surface of the first photosensitive drum; a second cleaning unit configured to remove toner remaining on a surface of the second photosensitive drum; and a conveying unit configured to convey toner removed by the first cleaning unit and the second cleaning unit. The conveying unit comprises: a first conveying member configured to rotate about a first axis extending in an arranging direction in which the first photosensitive drum and the second photosensitive drum are arranged and to convey the toner removed by the first cleaning unit and the second cleaning unit in a first direction along the arranging direction; a second conveying member configured to rotate about a second axis extending in the arranging direction and to convey the toner conveyed by the first conveying member in a second direction opposite to the first direction; and a conveying tube accommodating the first conveying member and the second conveying member, the conveying tube having a discharging outlet through which the toner conveyed by the first conveying member and the second conveying member is discharged to an outside.

BRIEF DESCRIPTION OF THE ACCOMPANYING DRAWINGS

Figure 4A:
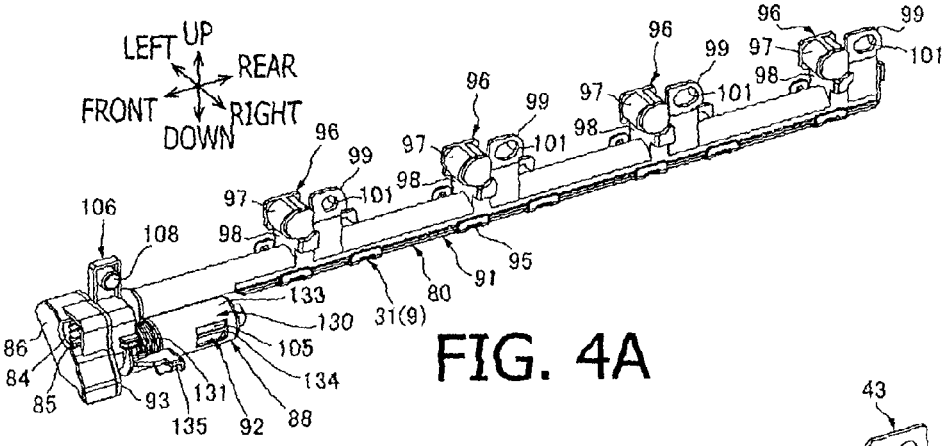
FIG. 4A is a perspective view of a conveying unit shown in FIG. 2 viewed from the upper right side.
Figure 5B:
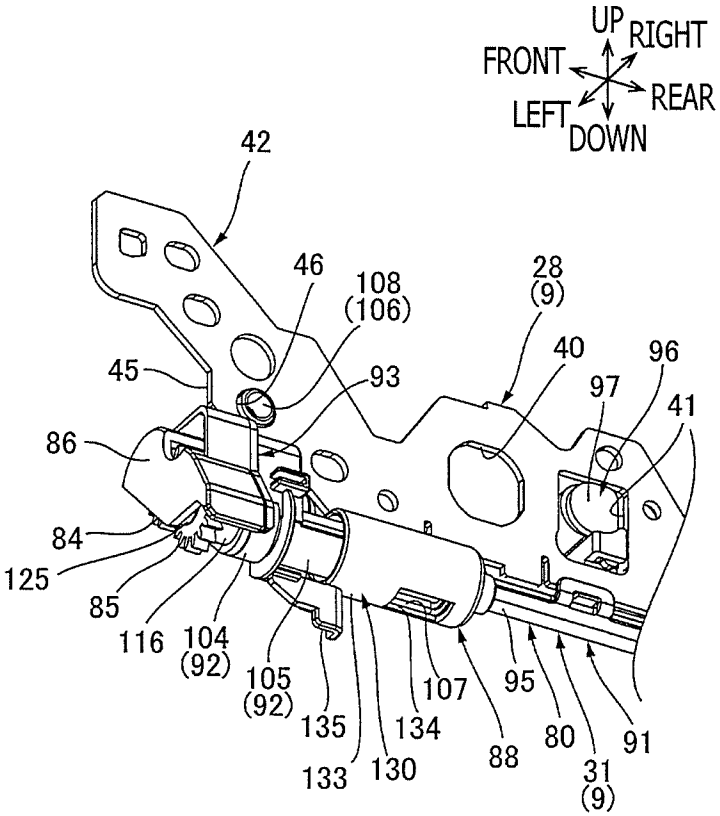
Figure 5A:
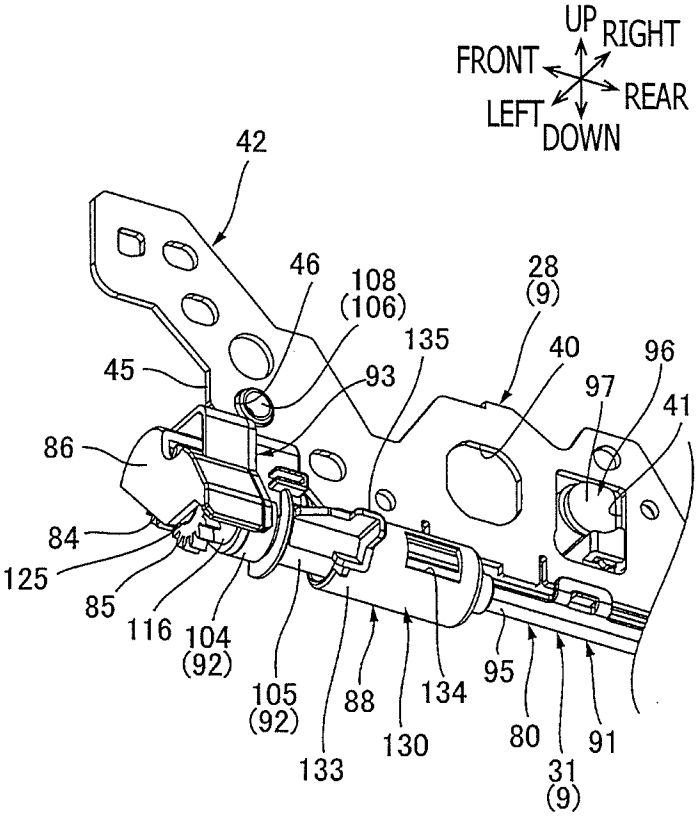

FIG. 5A is a perspective view of the conveying unit shown in FIG. 4A viewed from a lower right side and illustrates a state where a shutter is positioned at a closed position, FIG. 5B is a perspective view of the conveying unit shown in FIG. 4A viewed from a lower right side and illustrates a state where the shutter is positioned as an opened position, and, in each of FIGS. 5A and 5B, a pressing member is omitted for the sake of simplicity.

Figure 1:
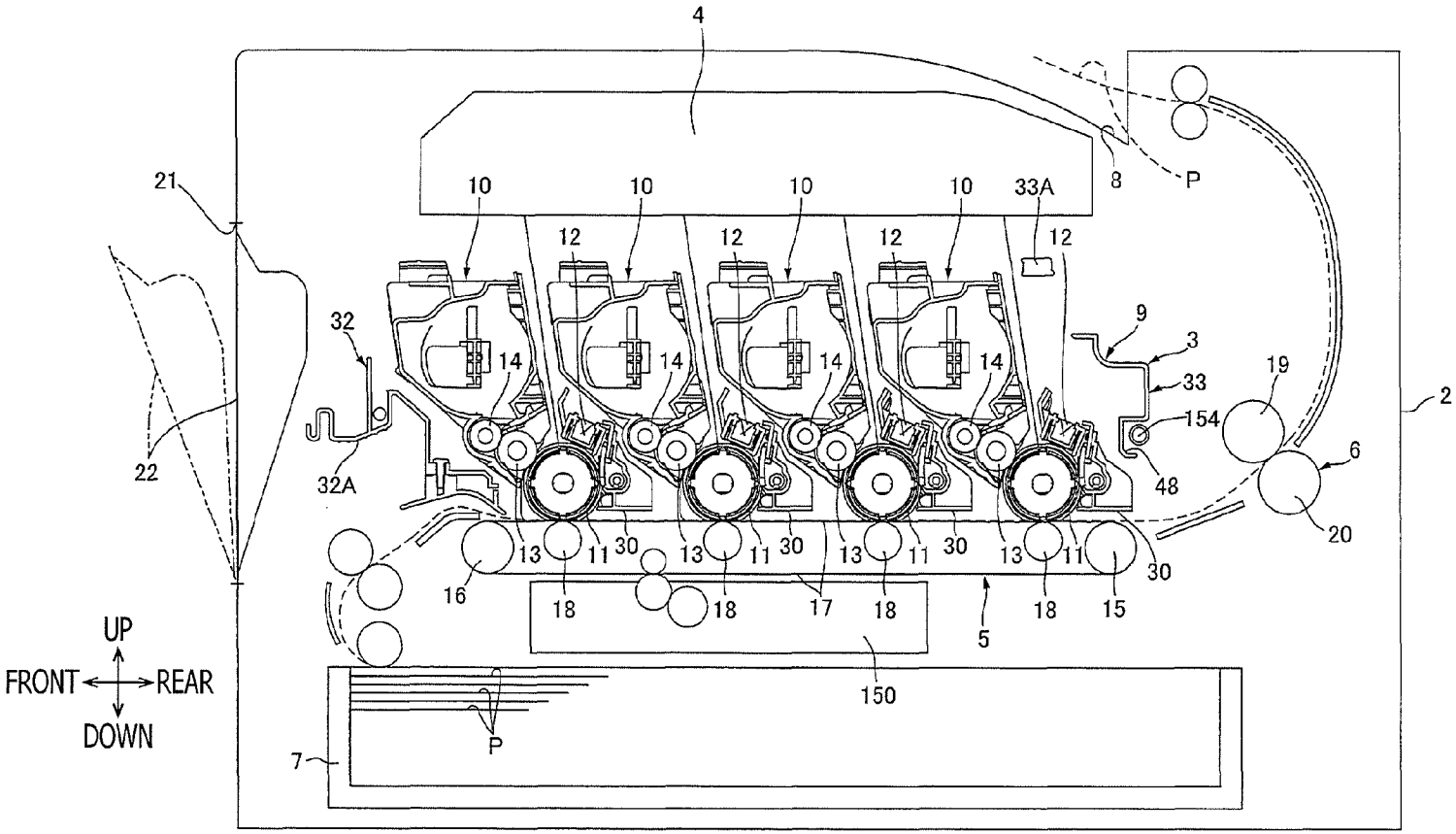
FIG. 1 is a central cross section of an image forming apparatus according to an embodiment.
Figure 6:
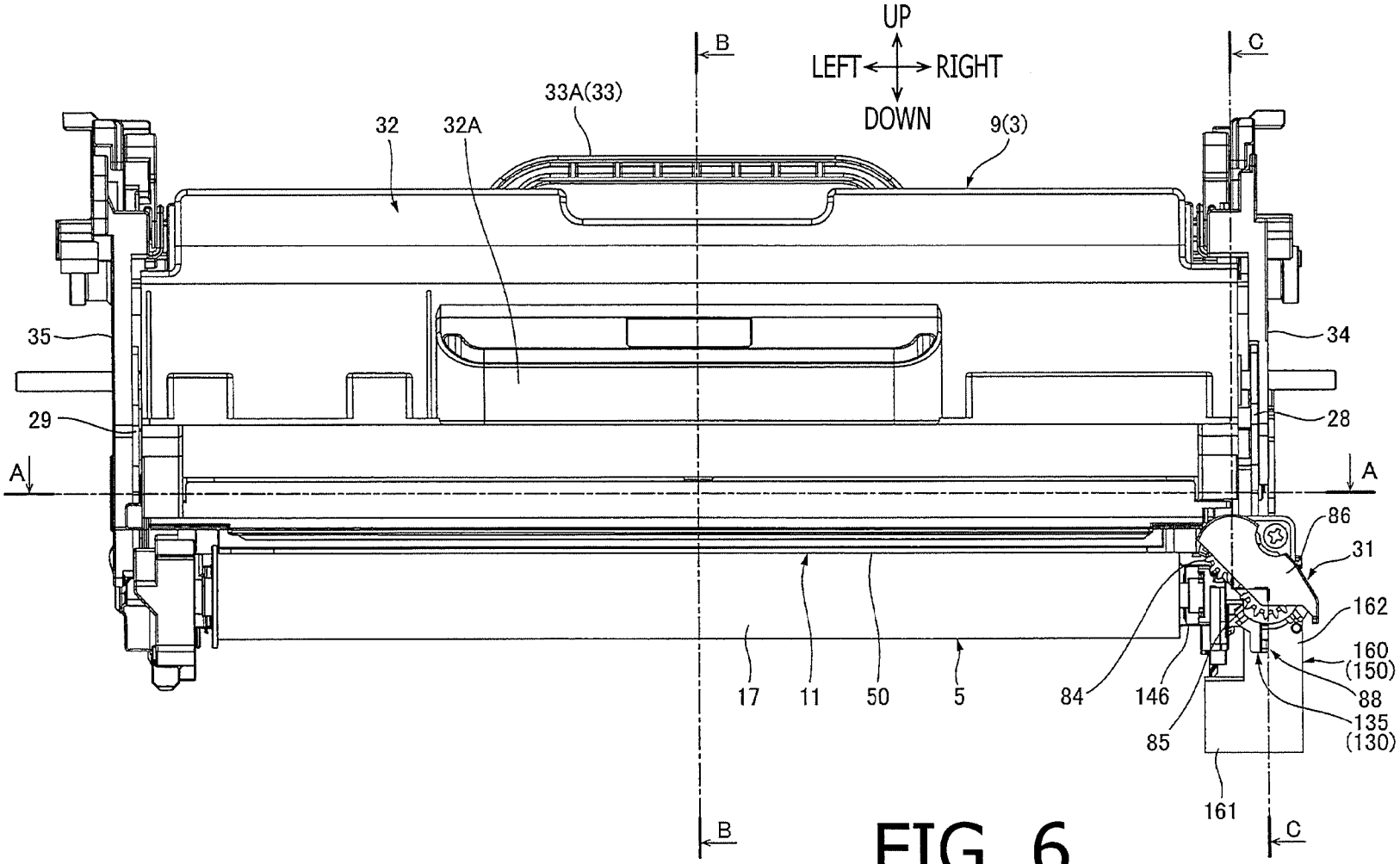

FIG. 6 is a front view of the drum unit and the belt unit shown in FIG. 1.

Figure 7:
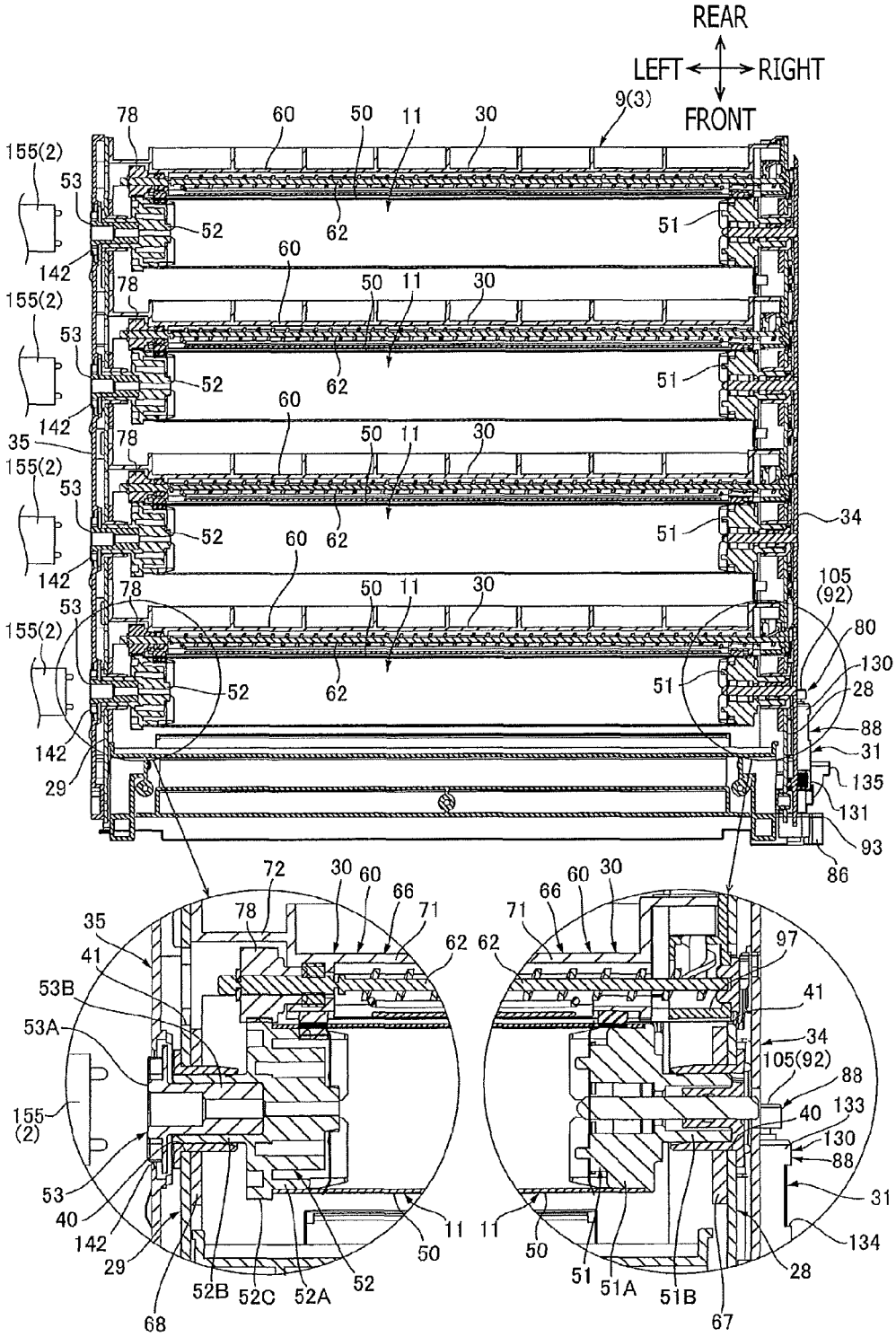

FIG. 7 is a cross section along a line A-A in FIG. 6.

Figure 8:
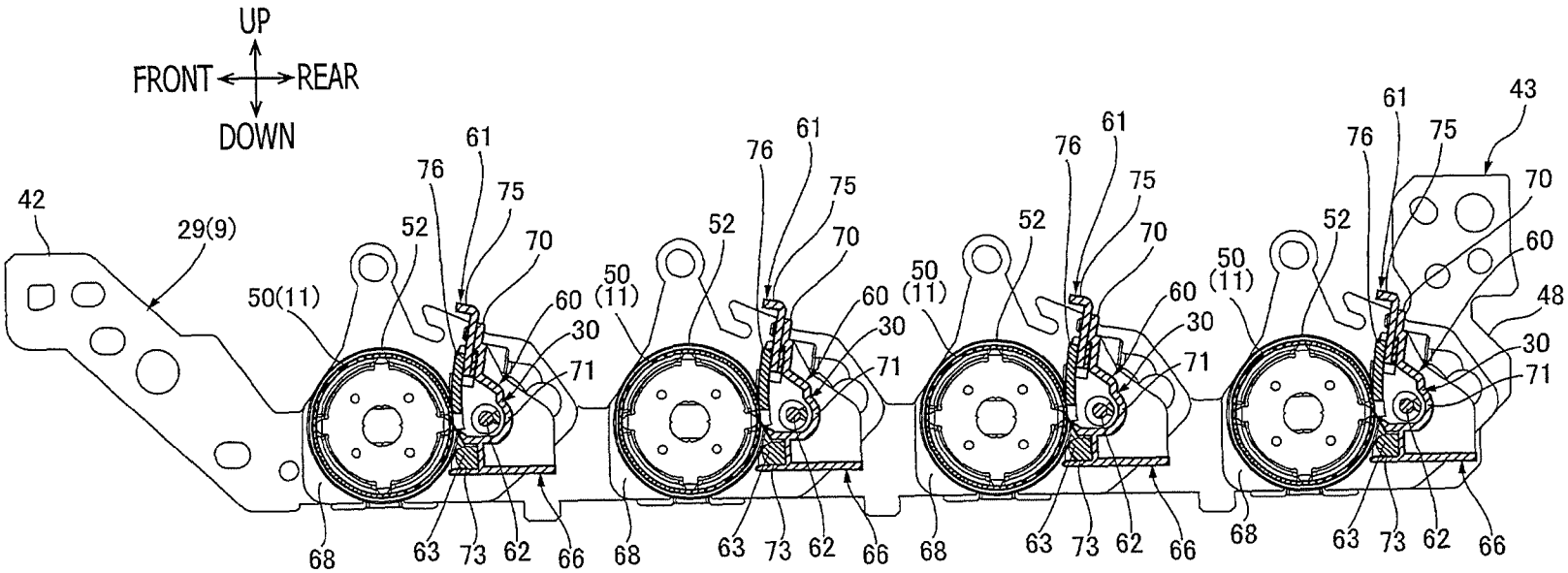

FIG. 8 is a cross section along a line B-B in FIG. 6 in which components other than a photosensitive drum, a cleaning unit and a second positioning member are omitted.

Figure 9:
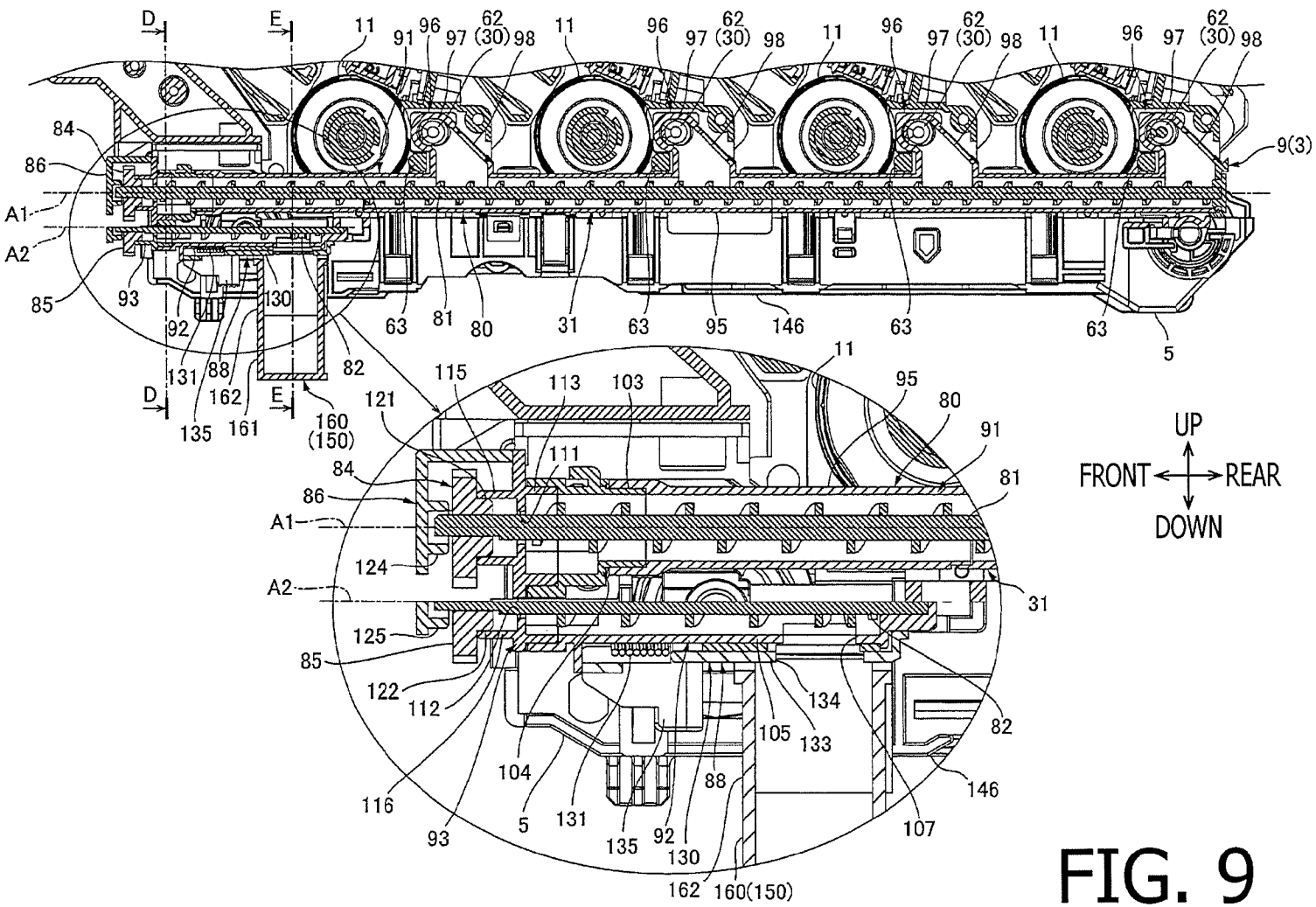

FIG. 9 is a cross section along a line C-C in FIG. 6.

Figure 2:
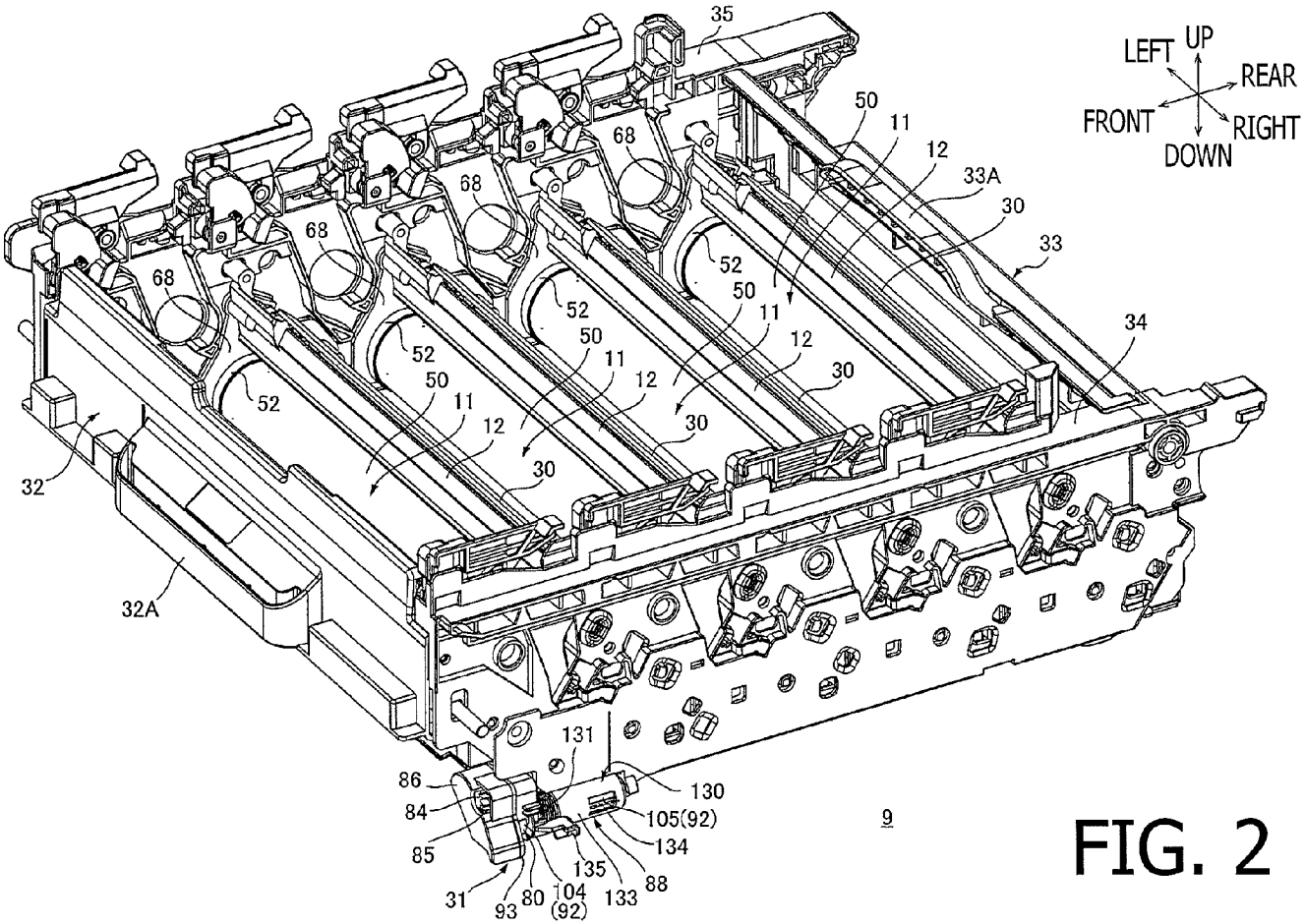
FIG. 2 is a perspective view of a drum unit shown in FIG. 1 viewed from an upper right side.
Figure 10:
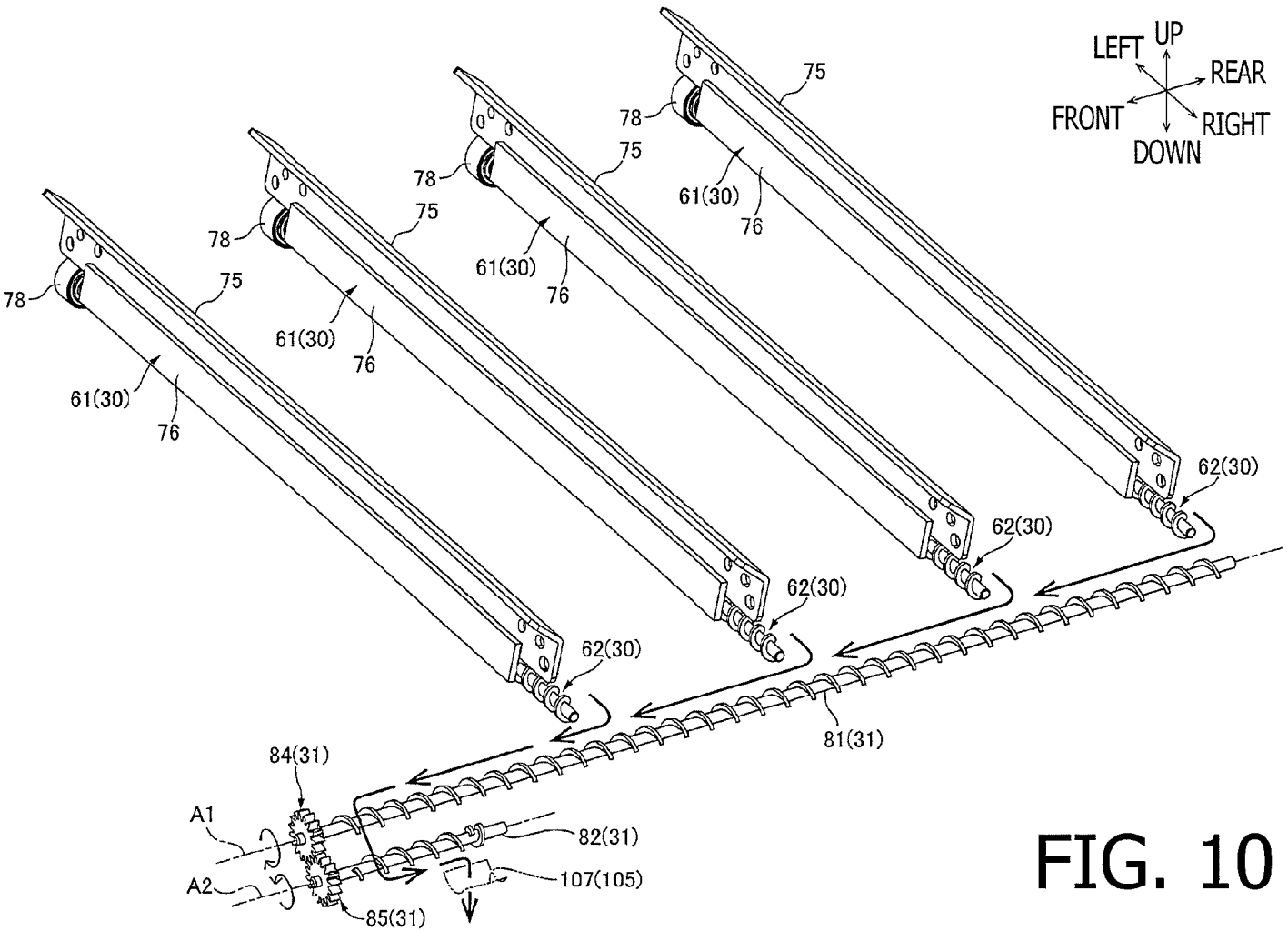

FIG. 10 is an explanatory illustration for explaining a conveying direction of toner in the drum unit shown in FIG. 2.

Figure 11B:
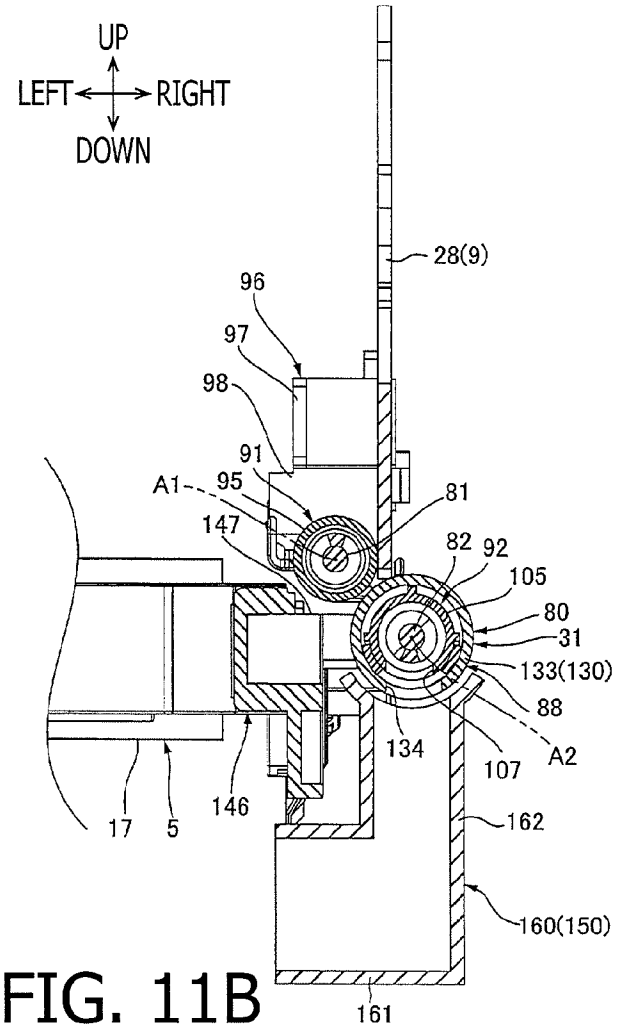
Figure 11A:
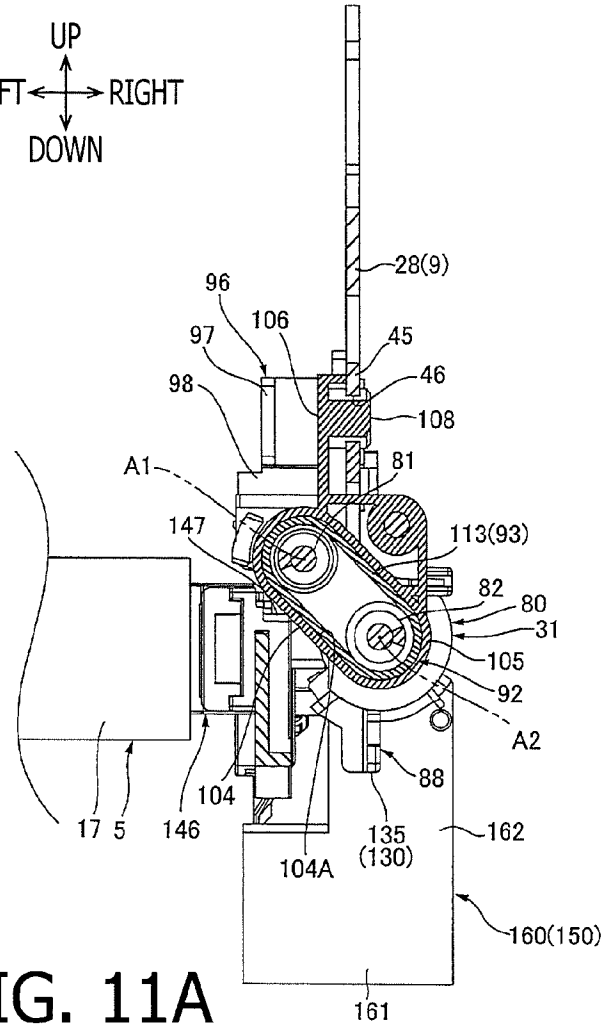

FIG. 11A is a cross section along a line D-D in FIG. 9, and FIG. 11B is across section along a line E-E in FIG. 9.

DETAILED DESCRIPTION

1. Overall Configuration of Image Forming Apparatus

As shown in FIG. 1, an image forming apparatus 1 is a horizontal direct tandem type color laser printer.

The image forming apparatus 1 includes a body casing 2 having an opening 21, a process unit 3, a scanner unit 4, a belt unit 5 and a fixing unit 6.

The body casing 2 is formed in a box-shape. The body casing 2 has a front cover 22, a paper supply tray 7 and a discharge tray 8.

The opening 21 is disposed at a front end part of the body casing 2. The opening 21 lets the inside of the body casing 2 and the outside of the body casing 2 communicate with each other in the front and rear direction so as to allow the process unit 3 to pass through the opening 21.

The front cover 22 is disposed at the front end part of the body casing 2. The front cover 22 has a flat plate-like shape. The front cover 22 is disposed to extend in the up and down direction and is supported to be able to swing, with respect to a front wall of the body casing 2, about a lower end of the front cover 22 serving as a fulcrum. Thus, the front cover 22 is configured to open or close the opening 21.

The paper supply tray 7 is disposed in a bottom portion of the body casing 2. The paper supply tray 7 is configured to store sheets of paper P.

The discharge tray 8 is disposed on an upper wall of the body casing 2. The discharge tray 8 is formed to be recessed downward from an upper surface of the body casing 2 so that the sheets of paper P can be placed on the discharge tray 8.

The process unit 3 is disposed in a central portion of the body casing 2. The process unit 3 is slidable in the front and rear direction, via the opening 21, between an inside position where the process unit 3 is disposed in the inside of the body casing 2 and an outside position where the process unit 3 is disposed outside the body casing 2. The process unit 3 includes a drum unit 9 and a plurality of (four in this embodiment) development cartridges 10.

The drum unit 9 includes a plurality of (four in this embodiment) photosensitive drums 11 and a plurality of (four in this embodiment) scorotron chargers 12.

The photosensitive drums 11 are rotatably supported at a lower end part of the process unit 3. The four photosensitive drums 11 correspond to yellow, magenta, cyan and black, respectively. The four photosensitive drums 11 are arranged from the front side to the rear side in the order of yellow, magenta, cyan and black to have intervals therebetween. Each photosensitive drum 11 has a cylindrical shape extending in the left and right direction.

The scorotron charger 12 is disposed on the upper rear side of the corresponding photosensitive drum 11 to have an interval therebetween.

The four development cartridges 10 have the same configuration excepting colors of the toner stored therein. The development cartridge 10 is disposed on the upper side of the corresponding photosensitive drum 11. The development cartridge 10 includes a development roller 13 and a supply roller 14.

The development roller 13 is rotatably supported in a lower end portion of the development cartridge 10 to be exposed toward the rear side. The development roller 13 contacts the upper front edge of the photosensitive drum 11.

The supply roller 14 is disposed on the upper front side of the development roller 13. The supply roller 14 contacts the upper front edge of the development roller 14.

The scanner unit 4 is disposed in an upper end portion of the body casing 2. As shown as solid lines in FIG. 1, the scanner unit 4 emits laser beams to the respective photosensitive drums 11 to expose the respective photosensitive drums 11.

The belt unit 5 is disposed under the process unit 3. The belt unit 5 includes a drive roller 15, a driven roller 16, a belt 17 and a plurality of (four in this embodiment) transfer rollers 18.

The drive roller 15 is disposed at a rear end part of the belt unit 5.

The driven roller 16 is disposed at a front end part of the belt unit 5 such that the driven roller 16 faces the drive roller 15 from the front side and has an interval with respect to the drive roller 15.

The belt 17 is provided to be wound around the drive roller 15 and the driven roller 16 such that, when the drum unit 9 is disposed at the inside position, an upper part of the belt 17 contacts all of the photosensitive drums 11. The belt 17 is moved to circulate in accordance with the driving motion of the drive roller 15 and the following motion of the driven roller 16 such that the upper part of the belt 17 moves from the front side to the rear side.

The transfer rollers 18 are disposed under the respective photosensitive drums 11 to sandwich the upper part of the belt 17 between the transfer rollers 18 and the photosensitive drums 11.

The fixing unit 6 is disposed on a rear side of the belt unit 5. The fixing unit 6 includes a heat roller 19 and a pressure roller 20 contacting the heat roller 19.

When image formation operation is started by the image forming apparatus 1, the scorotron charger 12 charges uniformly a surface of the photosensitive drum 11. Then, the scanner unit 4 exposes a surface of the photosensitive drum 11. As a result, an electrostatic latent image based on image data is formed on the surface of the photosensitive drum 11.

The supply roller 14 supplies toner in the development cartridge 10 to the development roller 13. At his time, the toner is charged positively between the development roller 13 and the supply roller 14, and is held on the development roller 13.

The development roller 13 supplies the toner which is held thereon, to the electrostatic latent image on the surface of the photosensitive drum 11. As a result, a toner image is held on the surface of the photosensitive drum 11.

Through rotations of the various rollers, the sheet of paper P is conveyed from the paper supply tray 7 toward the upper front side and then is conveyed toward the upper rear side while making a U-turn, so that the sheet of paper P is supplied one by one at predetermined timing to a position between the photosensitive drum 11 for yellow and the belt 17. Subsequently, the sheet of paper P is conveyed from the front side to the rear side by the belt 17. The toner image on the photosensitive drum 11 is transferred to the sheet of paper P while the sheet of paper P passes through the position between the photosensitive drum 11 and the transfer roller 18.

Then, the sheet of paper P is heated and pressed when the sheet of paper P passes through a position between the heat roller 19 and the pressure roller 20. At this time, the toner image on the sheet of paper P is thermally fixed to the sheet of paper P. Subsequently, the sheet of paper P is discharged to the discharge tray 8.

2. Details about Drum Unit

As shown in FIGS. 2 and 7, the drum unit 9 has a rectangular frame-like shape when viewed as a plan view. The drum unit 9 includes a first positioning plate 28 and a second positioning plate 29 each of which has a plurality of (four in this embodiment) holes 40 and a plurality of (four in this embodiment) holes 41, the plurality of (four in this embodiment) photosensitive drums 11, a plurality of (four in this embodiment) cleaning units 30, a conveying unit 31, a front plate 32, a rear plate 33, a first side plate 34, and a second side plate 35 having a plurality of (four in this embodiment) holes 142.

(1) First Positioning Plate and Second Positioning Plate

Figure 4B:
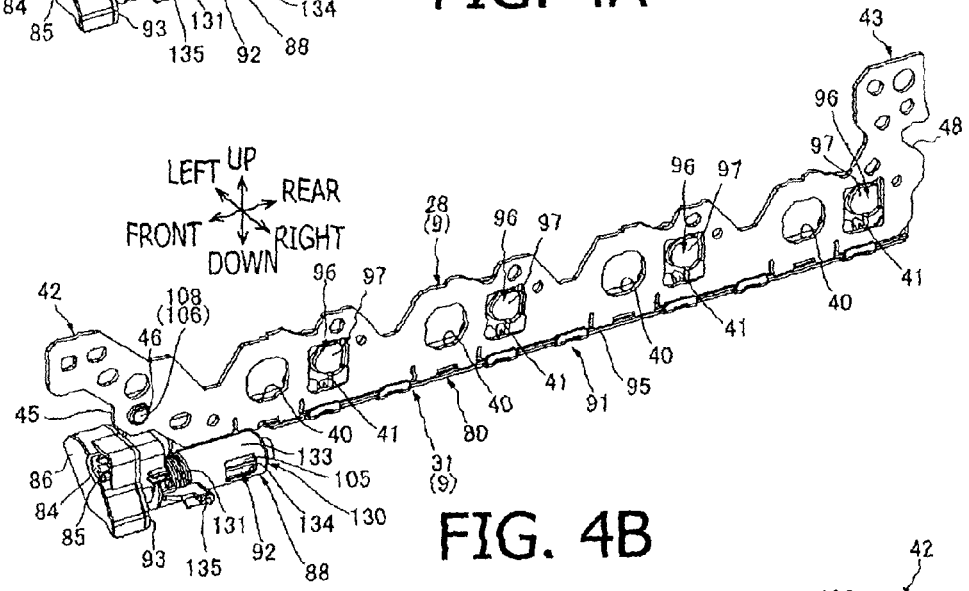
FIG. 4B illustrates a state where a first positioning plate is attached to the conveying unit shown in FIG. 4A.

As shown in FIG. 7, the first positioning plate 28 is disposed at a right end part of the drum unit 9. As shown in FIG. 4B, the first positioning plate 28 is a flat plate-like member having a rectangular shape elongated in the front and rear direction when viewed as a side view. The first positioning plate 28 includes an inclined part 42 and a bent part 43 having a notch 48.

The four holes 40 are disposed to have constant intervals therebetween in the front and rear direction. The holes 40 are disposed correspondingly with respect to the photosensitive drums 11. Each hole 40 has a circular shape when viewed as a side view.

The four holes 41 are disposed to have constant intervals therebetween in the front and rear direction. Each hole 41 is disposed on a rear side with respect to a corresponding hole 40. Each hole 41 has a rectangular shape when viewed as a side view.

The inclined part 42 is a flat plate-like member having a rectangular shape when viewed as a side view, and is formed to extend to an upper front side from the front end part of the first positioning plate 28. The inclined part 42 includes a projected part 45 having a hole 46.

The projected part 45 is a plate plate-like part having a substantially triangular shape when viewed as a side view, and is faulted to project toward the lower front side from a central portion of the inclined part 42 in a direction connecting the upper front part of the inclined part 42 to the lower rear part of the inclined part 42.

The hole 46 is disposed in a connection part of the projected part 45 and the inclined part 42. The hole 46 has a circular shape when viewed as a side view.

The bent part 43 has a rectangular flat plate-like shape when viewed as a side view, and is formed to extend upward from the rear end part of the first positioning plate 28.

The notch 48 is disposed at a rear end part of the bent part 43. The notch 48 is formed to be recessed to the front side from the rear edge of the bent part 43. The notch 48 has a shape of a letter V and the rear end part of the notch 48 is opened when viewed as a side view.

As shown in FIGS. 7 and 8, the second positioning plate 29 is disposed in a left end part of the drum unit 9 to be spaced leftward from the first positioning plate 28. The second positioning plate 29 has substantially the same shape as that of the first positioning plate 28. In contrast to the configuration where the first positioning plate 28 has the projected part 45 at the inclined part 42, the second positioning plate 29 does not have the projected part 45 at the inclined part 42. Since the configuration of the second positioning plate 29 is the same as that of the first positing plate 28 excepting the above described difference, explanation of the second positioning plate 29 will be omitted.

(2) Photosensitive Drum

As shown in FIG. 7, the photosensitive drum 11 includes a drum body 50, a first flange 51, a second flange 52 and a drum coupling 53.

The drum body 50 is disposed between the first positioning plate 28 and the second positioning plate 29. The drum body 50 is a metal tube having a cylindrical shape extending in the left and right direction, and has a photosensitive layer on an outer circumferential surface thereof.

The first flange 51 is fitted to the right end of the drum body 50 to be unable to relatively rotate with respect to the drum body 50. The first flange 51 includes a large diameter part 51A and a small diameter part 51B.

The large diameter part 51A is disposed at the left end of the first flange 51. The large diameter part 51A has a cylindrical shape, and the right end of the large diameter part 51A is closed. The outer diameter of the large diameter part 51A is substantially equal to the inner diameter of the drum body 50. The large diameter part 51A is inserted into the drum body 50 at the right end part of the drum body 50.

The small diameter part 51B is projected rightward from a right wall of the large diameter part 51A. The small diameter part 51B has a cylindrical shape having a center axis which is the same as that of the large diameter part 51A. The outer diameter of the small diameter part 51B is smaller than the outer diameter of the large diameter part 51A. The small diameter part 51B is fitted to the corresponding hole 40 of the first positioning plate 28.

By thus supporting the first flange 51, the first positioning plate 28 positions the photosensitive drum 11.

The second flange 52 is fitted to the left end of the drum body 50 to be unable to relatively rotate with respect to the drum body 50. The second flange 52 has a large diameter part 52A, a small diameter part 52B and a gear part 52C.

The large diameter part 52A is disposed at the right end of the second flange 52. The second flange 52 has a cylindrical shape. The outer diameter of the large diameter part 52A is substantially equal to the inner diameter of the drum body 50. The large diameter part 52A is inserted into the inside of the drum body 50 at the left end part of the drum body 50.

The gear part 52C is disposed next to the large diameter part 52A on the left side of the large diameter part 52A. The gear part 52C has a center axis which is the same as that of the large diameter part 52A, and has a circular plate-like shape having a thickness in the left and right direction. The gear part 52C has gear teeth on the entire circumferential surface thereof.

The small diameter part 52B projects leftward from the gear part 52C. The small diameter part 52B has a cylindrical shape having a center axis which is the same as that of the large diameter part 52A and the gear part 52C. The outer diameter of the small diameter part 52B is smaller than the outer diameter of the gear part 52C. The small diameter part 52B is fitted to the corresponding hole 40 of the second positioning plate 29.

By thus supporting the second flange 52, the second positioning plate 29 positions the photosensitive drum 11.

The drum coupling 53 is disposed at the left end part of the photosensitive drum 11. The drum coupling 53 includes a circular plate part 53A and a shaft part 53B.

The circular plate part 53A is disposed on the left side of the second positioning plate 29. The circular plate part 53A has a circular plate-like shape having a thickness in the left and right direction. The diameter of the circular plate part 53A is smaller than that of the large diameter part 52A of the second flange 52, and is larger than that of the small diameter part 52B of the second flange 52. The circular plate part 53A is configured to be fitted to a body coupling 155 of the body casing 2 to be unable to rotate relative to the body coupling 155.

The shaft part 53B projects rightward from the circular plate part 53A. The shaft part 53B has a cylindrical shape having a center axis which is the same as that of the circular plate part 53A. The outer diameter of the shaft part 53B is substantially equal to the inner diameter of the small diameter part 52B of the second flange 52. The shaft part 53B is fitted to the small diameter part 52B of the second flange 52 to be unable to rotate relative to the small diameter part 52B.

(3) Cleaning Unit

As shown in FIGS. 7 and 8, the cleaning unit 30 is disposed on the rear side of the corresponding photosensitive drum 11. The cleaning unit 30 is configured to remove toner adhered to and remaining on the surface of the drum body 50 of the photosensitive drum 11. The cleaning unit 30 includes a frame 60, a cleaning member 61, a cleaning conveying member 62, and a discharging member 63.

The frame 60 includes a body part 66, a first wall 67 and a second wall 68.

The body part 66 is disposed at a rear end part of the frame 60. The body part 66 has a shape of a substantially rectangular cylinder extending in the left and right direction, and left and right ends of the body part 66 are closed. The body part 66 includes a blade support part 70, a waste toner conveying part 71, a gear storage part 72 and a discharging member storage part 73.

As shown in FIG. 8, the blade support part 70 is disposed at an upper end part of the body part 66. The blade support part 70 has a plate-like shape extending in the left and right direction.

The waste toner conveying part 71 is disposed under the blade support part 70. The waste toner conveying part 71 has a shape of a half cylinder extending in the left and right direction. Further, the left end of the waste toner conveying part 71 is closed, and the right end and the front end of the waste toner conveying part 71 are opened. The upper end part of the waste toner conveying part 71 is formed to continue to the lower end of the blade support part 70.

As shown in FIG. 7, the gear storage part 72 is disposed on the left side of the waste toner conveying part 71. The gear storage part 72 has a shape of a half cylinder extending in the left and right direction, and the left and right ends of the gear storage part 72 are closed and the front end of the gear storage part 72 is opened.

As shown in FIG. 8, the discharge member storage part 73 is disposed under the waste toner conveying part 71. The discharge member storage part 73 has a rectangular cylinder shape extending in the left and right direction, and the front end of the discharge member storage part 73 is opened. The upper edge part of the discharge member storage part 73 is formed to continue to the lower end part of the waste toner conveying part 71.

As shown in FIG. 7, the first wall 67 is disposed at the right end part of the frame 60. The first wall 67 has a flat-plate shape extending frontward from the right end part of the body part 66. The first wall 67 contacts the inner surface of the first positioning plate 28.

As shown in FIGS. 7 and 8, the second wall 68 is disposed at the left end part of the frame 60. The second wall 68 has a flat-plate shape extending frontward from the left end part of the body part 66. The second wall 68 contacts the inner surface of the second positioning plate 29.

As shown in FIGS. 7 and 8, the cleaning member 61 includes a support member 75 and a blade 76.

The support member 75 is made of metal, and has a flat plate-like shape extending in the left and right direction. The support member 75 is fixed to the blade support part 70 of the frame 60.

The blade 76 is formed of an elastic member, such as rubber, and has a flat plate-like shape extending in the left and right direction. The upper edge part of the blade 76 is fixed to the support member 75. The lower edge part of the blade 76 faces the front part of the waste toner conveying part 71 so as to cover the upper half part of the waste toner conveying part 71. The lower edge part of the blade 76 is formed to be bent rearward and, in this structure, the lower edge part of the blade 76 contacts the rear edge part of the drum body 50 of the photosensitive drum 11.

As shown in FIGS. 7 and 8, the cleaning conveying member 62 is disposed in the waste toner conveying part 71. The cleaning conveying member 62 is a right-hand screw type auger screw extending in the left and right direction. The left end of the cleaning conveying member 62 is supported by a wall between the gear storage part 72 and the waste toner conveying part 71 to be able to rotate relative to the wall. The left end of the cleaning conveying member 62 penetrates through a part between the gear storage part 72 and the waste toner conveying part 71, and is disposed in the inside of the gear storage part 72. As shown in FIGS. 7 and 10, the cleaning conveying member 62 includes a gear 78.

The gear 78 is supported by the left end of the cleaning conveying member 62 in the gear storage part 72 so as to be unable to rotate relatively to the cleaning conveying member 62. The gear 78 has a cylindrical shape extending in the left and right direction, and has gear teeth on the entire circumferential surface thereof. As shown in FIG. 7, the gear 78 is disposed on the rear side of the second flange 52 of the photosensitive drum 11. The gear 78 engages with the gear part 52C of the second flange 52 of the photosensitive drum 11.

As shown in FIG. 8, the discharging member 63 is fixed in the discharging member storage part 73. The discharging member 63 has a half cylinder shape extending in the left and right direction. The front surface of the discharging member 63 is formed in a shape of an arc when viewed as a side view such that the central part of the front surface in the up and down direction projects frontward. Before the toner on the surface of the drum body 50 is removed by the corresponding cleaning member 61, the discharging member 63 exposes the toner on the surface of the drum body 50 of the photosensitive drum 11 after the toner image has been transferred to the sheet of paper P so as to reduce the charges on the surface of the drum body 50 of the corresponding photosensitive drum 11.

(4) Conveying Unit

As shown in FIGS. 2 and 6, the conveying unit 31 is disposed at the lower right end part of the drum unit 9. The conveying unit 31 is configured to convey the toner removed from the surfaces of the photosensitive drums 11 by the cleaning units 30, to a waste toner storage unit 150 which is described later. As shown in FIGS. 4A, 4B, 4C and 9, the conveying unit 31 includes a conveying tube 80, a first conveying member 81, a second conveying member 82, a first gear 84, a second gear 85, a gear cover 86 and a shutter unit 88.

The conveying tube 80 extends in the front and rear direction, i.e., a direction in which the drum unit 9 is movable. The conveying tube 80 includes a first conveying part 91, a second conveying part 92, and a closing part 93 having a hole 111 through which the first conveying member 81 passes and a hole 112 through which the second conveying member 82 passes.

The first conveying part 91 includes a first conveying tube 95 and a plurality of (four in this embodiment) connection parts 96.

The first conveying tube 95 has a cylindrical shape extending in the front and rear direction, and the rear end of the first conveying tube 95 is closed. As shown in FIG. 11B, the first conveying tube 95 is disposed to adjoin the lower edge part of the first positioning plate 28 on the left side of the lower edge part of the first positioning plate 28.

Figure 4C:
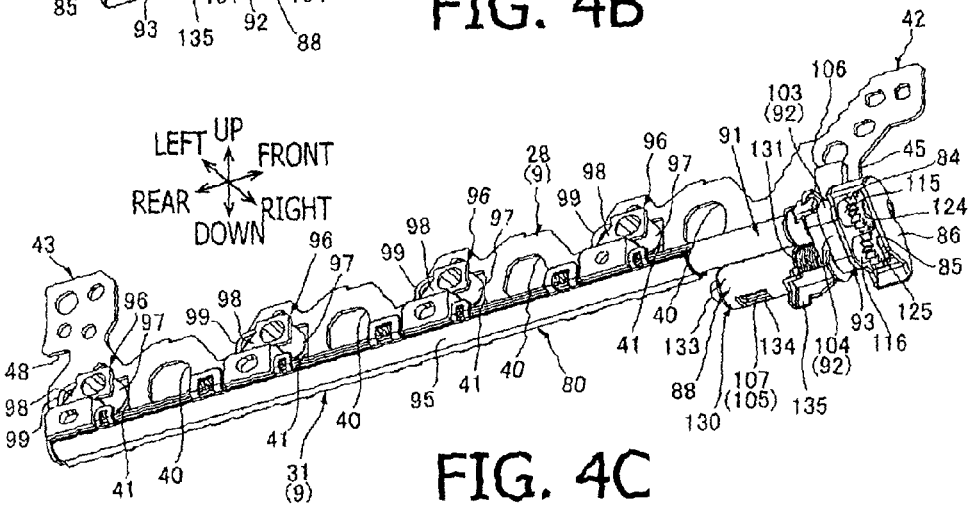
FIG. 4C is a perspective view in which the conveying unit shown in FIG. 4B and the first positioning plate are viewed from a lower left side.

As shown in FIGS. 4A and 4C, the four connection parts 96 are disposed, above the first conveying tube 95, to have intervals therebetween in the front and rear direction. Each connection part 96 includes an insertion part 97, a communicating part 98 and a fixing part 99 having a fixing hole 101.

The insertion part 97 is disposed at the upper front end part of the connection part 96. The insertion part 97 has a cylindrical shape extending in the left and right direction, and the left end of the insertion part 97 is opened and the right end of the insertion part 97 is closed. As shown in FIG. 7, the insertion part 97 is connected to the right end of the frame 60 of the cleaning unit 30 with a sealing member (not shown). The right end of the cleaning conveying member 62 of the cleaning unit 30 is inserted into the inside of the insertion part 97.

As shown in FIGS. 4C and 9, the communicating part 98 is disposed on the rear side of the discharging member 63 and the lower rear side of the insertion part 97. The communicating part 98 has a shape of a substantially rectangular cylinder extending in the up and down direction. The upper rear end part of the communicating part 98 is inclined toward the upper front side from the lower end part thereof. The upper front end part of the communicating part 98 communicates with the lower rear end part of the insertion part 97. The lower end part of the communication part 98 communicates with the upper end part of the first conveying tube 95.

As shown in FIGS. 4A and 4C, the fixing part 99 is disposed at the upper rear end part of the connection part 96. The fixing part 99 has a rectangular flat plate shape extending upward from the right end of the communicating part 98 when viewed as a side view.

The fixing hole 101 is disposed in the central portion of the fixing part 99. The fixing hole 101 penetrates through the fixing part 99 in the left and right direction. The fixing hole 101 has a circular shape when viewed as a side view.

Although not shown in the drawings, the fixing part 99 is sandwiched between the right end part of the frame 60 of the cleaning unit 30 and the first positioning plate 28, and by screwing a screw member into the fixing hole 101, the fixing part 99 is fixed to the frame 60 of the cleaning unit 30 and the first positioning plate 28.

As shown in FIGS. 9 and 11A, the second conveying part 92 includes a communicating tube 103, a second conveying tube 104, a third conveying tube 105 having a discharging outlet 107, and an engagement part 106.

The communicating tube 103 is disposed at the upper left end part of the second conveying part 92. The communicating tube 103 extends in the front and rear direction, and has a cylindrical shape having the center axis which is the same as that of the first conveying tube 95. The communicating tube 103 is fitted into the front end part of the first conveying tube 95.

As shown in FIGS. 4C and 11A, the second conveying tube 104 is disposed on the lower right side of the front end part of the communicating tube 103. The second conveying tube 104 has a rectangular cylinder shape extending in a direction connecting the upper left side and the lower right side, and the front side of the second conveying tune 104 is opened. That is, the second conveying tube 104 extends in the direction intersecting with the direction in which the first conveying tube 95 extends. The upper left end part of the second conveying tube 104 communicates with the lower right end part of the front end part of the communicating tube 103. That is, the second conveying tube 104 communicates with the front end part of the first conveying tube 95 via the communicating tube 103. As shown in FIG. 11A, the lower left surface of the inner part of the second conveying tube 104 is formed as an inclined surface 104A which is inclined to become lower at a point farther from the first conveying tube 95.

As shown in FIGS. 5A and 9, the third conveying tube 105 has a cylindrical shape extending rearward from the lower right end part of the second conveying tube 104, and the rear end of the third conveying tube 105 is closed. The third conveying tube 105 extends in the same direction as the direction in which the first conveying tube 95 extends. The third conveying tube 105 is connected with the first conveying tube 95 via the second conveying tube 104 such that the inside and outside of the third conveying tube 105 communicates with the first conveying tube 95. In other words, the second conveying tube 104 connects the first conveying tube 95 with the third conveying tube 106. That is, in the conveying tube 80, the second conveying tube 104 connects the most downstream part of the first conveying tube 95 in a first direction with the most upstream part of the third conveying tube 105 in a second direction. As shown in FIG. 11B, the third conveying tube 105 is disposed on the lower side of the first positioning plate 28. As shown in FIG. 9, the rear end part of the third conveying tube 105 is positioned on the front side of the center axis of the frontmost photosensitive drum 11 and on the front side of the frontmost connection part 96.

The discharging outlet 107 is disposed at the rear end part of the third conveying tube 105. The discharging outlet 107 penetrates through the lower wall of the third conveying tube 105 in the up and down direction. The discharging outlet 107 has a rectangular shape when viewed as a bottom view. The discharging outlet 107 is disposed on the front side of the center axis of the frontmost photosensitive drum 11. As shown in FIG. 11B, the discharging outlet 107 overlaps with the first positing plate 28 in the up and down direction. In other words, the discharging outlet 107 is disposed on the outside with respect to a first axis A1 of the first conveying member 81 in the left and right direction.

As shown in FIGS. 4A and 11A, the engagement part 106 has a rectangular flat plate shape projecting upward from the upper part of the communicating tube 103 when viewed as a side view. The engagement part 106 is disposed on the left side of the projected part 45 of the first positioning plate 28. The engagement part 106 has a boss 108.

The boss 108 has a cylindrical shape projecting rightward from the right surface of the engagement part 106. The boss 108 is fitted into the hole 46 of the first positioning plate 28.

As shown in FIGS. 4C and 9, the closing part 93 is disposed at the front end part of the conveying tube 80. The closing part 93 has a rectangular flat plate shape extending to connect the upper left side and the lower right side when viewed as a front view. The closing part 93 includes an insertion part 113, a supporting part 115 supporting the first gear 84, and a supporting part 116 supporting the second gear 85.

The hole 111 is disposed in the central part in the upper left part of the closing part 93. The closing part 93 has a circular shape when viewed as a front view. The hole 111 has the center axis which is the same as that of the first conveying member 81.

The hole 112 is disposed in the central part of the lower right part of the closing part 93. The hole 112 has a circular shape when viewed as a front view. The hole 112 has the center axis which is the same as that of the second conveying member 82.

As shown in FIG. 9, the insertion part 113 extends rearward from the rear surface of the closing part 93. As shown in FIG. 11A, the insertion part 113 has an elliptical cylinder shape when viewed as a cross sectional view. The insertion part 113 is fitted into the front end of the second conveying part 92.

As shown in FIG. 9, the supporting part 115 has a cylindrical shape extending frontward from a part on the front surface of the closing part 93 slightly spaced from the periphery of the hole 111. The supporting part 115 has the center axis which is the same as that of the hole 111.

The supporting part 116 has a cylindrical shape extending frontward from a part on the front surface of the closing part 93 slightly spaced from the periphery of the hole 112. The supporting part 116 has the center axis which is the same as that of the hole 112.

The first conveying member 81 is disposed in the first conveying tube 95 of the first conveying part 91. As shown FIGS. 9 and 10, the first conveying member 81 is a right-hand screw type auger screw rotatable about the first axis A1 extending in the front and rear direction. The rear end of the first conveying member 81 is rotatably supported by the rear wall of the first conveying tube 95. The front end of the first conveying member 81 passes through the hole 111 of the closing part 93, and extends to the front side with respect to the front end of the supporting part 115.

As shown in FIG. 9, the second conveying member 82 is disposed in the third conveying tube 105 of the second conveying part 92. As shown in FIGS. 9 and 10, the second conveying member 82 is a right-hand screw type auger screw rotatable about the second axis A2 extending in the front and rear direction. The second conveying member 82 is disposed on the lower right side of the first conveying member 81. In other words, the first axis A1 of the first conveying member 81 is disposed on the upper side with respect to the second axis A2 of the second conveying member 81. The second conveying member 82 is parallel with the first conveying member 81. The size of the second conveying member 82 in the front and rear direction is smaller than the size of the first conveying member 81 in the front and rear direction. The rear end of the second conveying member 82 is rotatably supported by the rear wall of the third conveying tube 105. The front end of the second conveying member 82 extends to the front side with respect to the front end of the supporting part 116 of the closing part 93.

The first gear 84 is supported, on the front side of the closing part 93, by the front end of the first conveying member 81 to be unable to rotate. The first gear 84 has a cylindrical shape extending in the front and rear direction, and has gear teeth on the entire circumferential surface of the first gear 84. That is, the first gear 84 is fixed to the first conveying member 81, and is rotatable together with the first conveying member 81. Further, as shown in FIG. 9, the first gear 84 includes a first boss 121.

The first boss 121 projects rearward from the rear surface of the first gear 84, and has a cylindrical shape having the center axis which is the same as that of the first gear 84. The first boss 121 is rotatably fitted to the supporting part 115 of the closing part 93.

As shown in FIGS. 9 and 10, the second gear 85 is supported, on the front side of the closing part 93, by the front end part of the second conveying member 82 to be unable to rotate. The second gear 85 has a cylindrical shape extending in the front and rear direction, and has gear teeth on the entire circumferential surface of the second gear 85. That is, the second gear 85 is fixed to the second conveying member 82, and is able to rotate together with the second conveying member 85. The second gear 85 engages with the lower right edge part of the first gear 84. Further, the second gear 85 has a second boss 122 as shown in FIG. 9.

The second boss 122 projects rearward from the rear surface of the second gear 85, and has a cylindrical shape having the center axis which is the same as that of the second gear 85. The second boss 122 is rotatably fitted to the supporting part 116 of the closing part 93.

As shown in FIGS. 4C and 9, the gear cover 86 is disposed at the front end part of the conveying unit 31. The gear cover 86 has a box-like shape, and the rear part and the lower left part of the gear cover 86 are opened. The gear cover 86 covers the first gear 84 and the second gear 85 from the front side such that the lower left edge parts of the first gear 84 and the second gear 85 are exposed. Further, the gear cover 86 includes a supporting part 124 supporting the first conveying member 81 and a supporting part 125 supporting the second conveying member 82.

The supporting part 124 has a cylindrical shape projecting rearward from the rear surface of the front wall of the gear cover 86. The supporting part 124 has the center axis which is the same as that of the first conveying member 81. The supporting part 124 receives the front end of the first conveying member 81 to allow the first conveying member 81 to be able to relatively rotate.

The supporting part 125 has a cylindrical shape projecting rearward from the rear surface of the gear cover 86 on the lower right side of the supporting part 124. The supporting part 125 has the center axis which is the same as that of the second conveying member 82. The supporting part 125 receives the front end of the second conveying member 82 to allow the second conveying member 82 to be able to relatively rotate.

As shown in FIG. 2, the shutter unit 88 is mounted on the third conveying tube 105 of the second conveying part 92. The shutter unit 88 includes a shutter 130 and a pressing member 131.

The shutter 130 is configured to rotate between a closing position shown in FIG. 5A where the shutter 130 closes the discharging outlet 107 of the third conveying tube 105, and a releasing position shown in FIG. 5B where the shutter 130 releases the discharging outlet 107 of the third conveying tube 105. In the following explanation about the shutter 130, the explanation is made with reference to a state where the shutter 130 is at the closing position shown in FIG. 5A.

As shown in FIGS. 4A and 5A, the shutter 130 includes a shutter body 133 having a communication hole 134, and a projection 135.

The shutter body 133 has a cylindrical shape extending in the front and rear direction. The shutter body 133 receives therein the third conveying tube 135.

The communication hole 134 penetrates through a right wall of the shutter body 133. The communication hole 134 has a rectangular shape when viewed as a side view. The communication hole 134 is disposed substantially at the same position as that of the discharging outlet 107 in regard to the front and rear direction.

The projection 135 is a flat plate-like member having a L-shape projecting to the right side from the front right end of the shutter body 133 when viewed as a side view. The front end of the projection 135 is disposed on the front side with respect to the front end of the shutter body 133. When the shutter 130 is disposed at the releasing position shown in FIG. 5B, the projection 135 is disposed at a first position where the projection 135 extends downward from the shutter body 133. When the shutter 130 is disposed at the closing position shown in FIG. 5A, the projection 135 is disposed at a second position where the projection 135 extends to the right side from the shutter body 133.

As shown in FIGS. 4A and 9, the pressing member 131 is a coil spring having a coil shape formed by winding a wire in a spiral shape along the front and rear direction. The pressing member 131 receives therein the front end part of the third conveying tube 105. The pressing member 131 overlaps with the projection 135 of the shutter 130 in regard to the front and rear direction. Although not shown in the drawings, the pressing member 131 is disposed such that one end of the wire of the pressing member 131 is fixed to the third conveying tube 105, and the other end of the wire of the pressing member 131 is fixed to the projection 135. With this configuration, the pressing member 131 constantly presses the projection 135 in the counterclockwise direction when viewed as a front view such that the pressing member 131 lets the projection 135 be disposed at the second position and lets the shutter 130 be disposed at the closing position.

(5) Front Plate, Rear Plate, First Side Plate and Second Side Plate

As shown in FIGS. 2 and 6, the front plate 32 is disposed at the front end part of the drum unit 9. The front plate 32 has a rectangular flat plate shape elongated in the left and right direction when viewed as a front view. The front plate 32 is provided to extend between the front end part of the first positioning plate 28 and the front end part of the second positioning plate 29. The front plate 32 has a front grip part 32A.

The front grip part 32A is disposed in the central portion of the front plate 32 in the left and right direction. The front grip part 32A projects frontward from the front surface of the front plate 32, and has a flat plate shape extending in the left and right direction.

The rear plate 33 is disposed at the rear end part of the drum unit 9. The rear plate 33 has a rectangular flat plate shape elongated in the left and right direction when viewed as a front view. The rear plate 33 is provided to extend between the rear end part of the first positing plate 28 and the rear end part of the second positioning plate 29. The rear plate 33 has a rear grip part 33A.

The rear grip part 33A is disposed at the upper end part of the rear plate 33. The rear grip part 33A projects upward from the upper surface of the rear plate 33 and extends in the left and right direction. The rear grip part 33A has a rectangular flat plate shape when viewed as a rear view.

As shown in FIGS. 2 and 7, the first side plate 34 is disposed on the right side of the first positioning plate 28. The first side plate 34 has a rectangular flat plate shape which is wider in the up and down direction than the first positioning plate 28 when viewed as a side view.

The second side plate 35 is disposed on the left side of the second positioning plate 29. The second side plate 35 has a rectangular flat plate shape which is wider in the up and down direction than the second positioning plate 29 when viewed as a side view.

As shown in FIG. 7, the four holes 142 are arranged in the front and rear direction to have intervals therebetween. The holes 142 are provided respectively for the photosensitive drums 11. Each hole 142 has a circular shape when viewed as a side view. The hole 142 receives the drum coupling 53 of the corresponding photosensitive drum 11.

3. Configuration of Belt Unit

Figure 3:
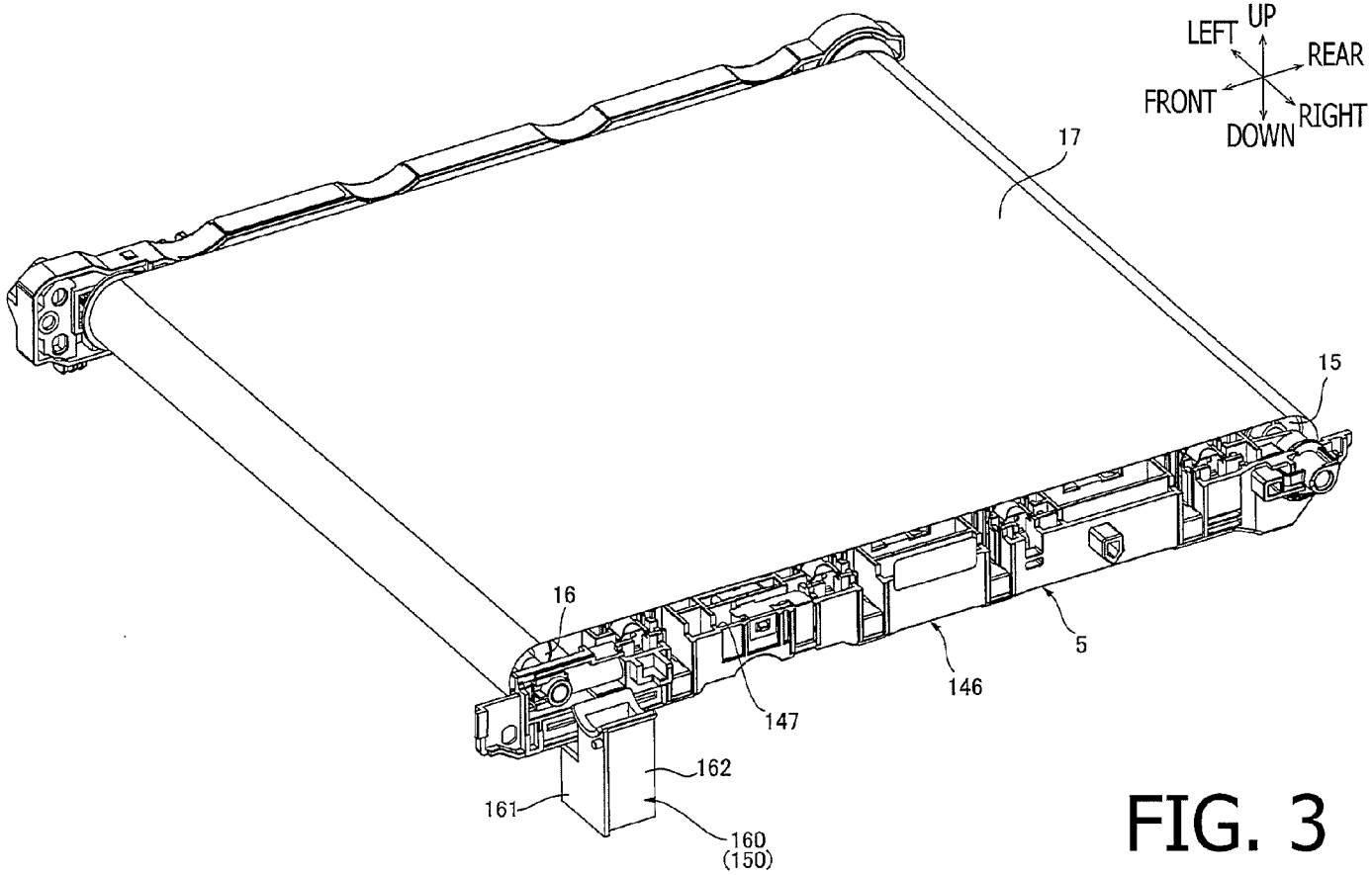
FIG. 3 is a perspective view of a belt unit shown in FIG. 1 viewed from the upper right side.

As shown in FIGS. 3 and 11B, the belt unit 5 includes a frame 146 having a recessed part 147.

The frame 146 has a frame-like shape supporting the drive roller 15, the driven roller 16 and the four transfer rollers 18. The frame 146 extends, in the left and right direction, to the outsides with respect to the left and right ends of the belt 17.

The recessed part 147 is formed to be recessed over the entire region of the upper right end of the frame 146 in the front and rear direction.

4. Configuration of Body Casing

As shown in FIG. 1, the body casing 2 includes the waste toner storage unit 150, a body reference shaft 154 and the body coupling 155 (see FIG. 7).

The waste toner storage unit 150 is disposed under the belt unit 5. The waste toner storage unit 150 is configured to store the toner removed by the cleaning unit 30. As shown in FIGS. 3 and 6, the waste toner storage unit 150 includes an introducing tube 160.

The introducing tube 160 is disposed at the right end part of the front end part of the waste toner storage unit 150. The introducing tube 160 includes a first part 161 and a second part 162.

The first part 161 has a rectangular cylinder shape extending in the left and right direction. The left end of the first part 161 communicates with the inner space of the waste toner storage unit 150.

The second part 162 is disposed on the right side of the front end part of the frame 146 of the belt unit 5. The second part 162 has a rectangular cylinder shape extending in the up and down direction. The lower end of the second part 162 communicates with the first part 161.

As shown in FIG. 1, the body reference shaft 154 is disposed at the rear end part of the body casing 2. The body reference shaft 154 is made of metal, and has a cylindrical shape extending in the left and right direction.

As shown in FIG. 7, the four body couplings 155 are arranged in the front and rear direction to have intervals therebetween. The body couplings 155 are disposed on the left side of the respective photosensitive drums 11. In a state where the process unit 3 is attached to the body casing 2, the right end of the body coupling 155 is fitted into the drum coupling 53. The body coupling 155 is configured to move in the left and right direction in conjunction with opening and closing motion of the front cover 22 through an interlocking mechanism which may have a configuration known in the art. The body coupling 155 is configured to rotate by a driving force transmitted from a driving source, such as a motor (not shown), provided in the body casing 2.

5. Attaching and Detaching Operation of Drum Unit

As shown in FIG. 1, in a state where the drum unit 9 is disposed at the inside position in the body casing 2, the notch 48 of the first positioning plate 28 is fitted to the right end of the body reference shaft 154. Further, although not shown in the drawings, the notch 48 of the second positioning plate 29 is fitted to the left end of the body reference shaft 154. As a result, the drum unit 9 is positioned at the inside position.

At this time, as shown in FIGS. 1 and 6, the lower edge of the photosensitive drum 11 contacts the upper part of the belt 17. Further, as shown in FIGS. 4C and 11A, since a contacting part (not shown) of the body casing 2 contacts the projection 135, the projection 135 is positioned at the first position where the projection 135 extends downward. As a result, as shown in FIGS. 4C and 11B, the communication hole 134 is positioned, under the shutter body 133, at the releasing position where the communication hole 134 communicates with the discharging outlet 107 of the third conveying tube 105 in the up and down direction. As shown in FIGS. 9 and 11B, the discharging outlet 107 of the third conveying tube 105 is connected to the upper end part of the second part 162 of the introducing tube 160 of the waste toner storage unit 150. The conveying tube 80 communicates with the upper end part of the second part 162 of the introducing tube 160 of the waste toner storage unit 150 via the discharging outlet 107. As shown in FIG. 11B, the third conveying tube 105 does not overlap with the belt unit 5 when viewed along the up and down direction.

The first conveying tube 95 is stored in the recessed part 147 of the frame 146. As a result, a part of the first conveying tube 95 overlaps with the frame 146 of the belt unit 5 when viewed along the up and down direction.

The body coupling 155 shown in FIG. 7 is fitted to the corresponding drum coupling 53.

In order to move the drum unit 9 to the outside position, first, a worker opens the front cover 22 of the body casing 2 as shown in FIG. 1.

Then, as shown in FIG. 7, the body coupling 155 moves leftward in conjunction with opening motion of the front cover 22 through the known interlocking mechanism, and thereby is separated from the drum coupling 53.

Then, the worker holds the front grip part 32A of the drum unit 9 to move the drum unit 9 frontward.

At this time, the drum unit 9 moves frontward after moving to the upper front side slightly by a guide (not shown).

Then, the projection 135 of the shutter 130 and the contacting part (not shown) separates from each other in accordance with movement of the drum unit 9.

As a result, as shown in FIGS. 2 and 4A, the shutter 130 rotates in the counterclockwise direction when viewed as a front view by the pressing force of the pressing member 131, is positioned at the second position where the projection 135 extends rightward, and is positioned at the closing position where the discharging outlet 107 is closed by the peripheral wall of the shutter body 133.

Then, the worker further draws the drum unit 9 frontward.

Thus, the drum unit 9 is positioned at the outside position, and the drawing operation for the drum unit 9 is finished.

In order to move the drum unit 9 from the outside position to the inside position, the drum unit 9 is operated in a manner reverse to the above described drawing operation.

Specifically, the worker holds the front grip part 32A of the drum unit 9 and presses rearward the drum unit 9.

Then, the drum unit 9 moves rearward. The projection 135 of the shutter 130 contacts the contacting part (not shown) of the body casing 2 while the drum unit 9 is moved.

Next, when the worker further presses the drum unit 9 rearward, the drum unit 9 moves to the lower rear side by being guided by a guide (not shown) and is disposed at the inside position.

At this time, as shown in FIG. 11A, the projection 135 of the shutter 130 is positioned at the first position by contacting the contacting part (not shown) of the body casing 2.

As a result, as shown in FIG. 11B, the shutter 130 is positioned at the releasing position, and the discharging outlet 107 of the third conveying tube 105 is connected to the upper end part of the second part 162 of the introducing tube 160 of the waste toner storage unit 150.

When the worker subsequently closes the front cover 22, the body coupling 155 moves rightward in conjunction with the closing motion of the front cover 22 by the know interlocking mechanism, and is fitted to the drum coupling 53 of the corresponding photosensitive drum 11.

Thus, the attaching operation of the drum unit 9 is finished.

6. Cleaning Operation

Next, the cleaning operation for remaining toner adhered to the surface of the drum body 50 of the photosensitive drum 11 is explained.

During image formation operation, the blade 76 of the cleaning member 61 of the cleaning unit 30 contacting the drum body 50 of the photosensitive drum 11 scrapes and removes the toner remaining on the drum body 50 of the photosensitive drum 11 through rotation of the photosensitive drum 11 (see FIG. 8).

The toner removed from the surface of the drum body 50 falls into the waste toner conveying part 71 of the body part 66 of the frame 60. That is, the toner remaining on the surface of the drum body 50 is collected by the cleaning member 61.

At this time, since the gear 78 engages with the second flange 52 of the photosensitive drum 11, the cleaning conveying member 62 rotates in the clockwise direction when viewed as a right side view.

As a result, the toner in the waste toner conveying part 71 is conveyed to the right side by the cleaning conveying member 62.

As shown in FIG. 9, the waste toner conveyed to the right side in the waste toner conveying part 71 flows into the first conveying tube 95 via the insertion part 97 and the communicating part 98 of the connection part 96.

At this time, as shown in FIG. 7, since the second gear 85 receives a driving force from a driving gear (not shown) of the body casing 2, the second conveying member 82 rotates in the counterclockwise direction when viewed as a front view.

Further, as shown in FIG. 10, the first gear 84 receives a driving force from a driving gear (not shown) of the body casing 2, the first conveying member 81 rotates in the clockwise direction when viewed as a front view.

As a result, as shown in FIG. 9, the toner flowed into the first conveying tube 95 is conveyed frontward by the first conveying member 81. A direction in which the toner is conveyed by the first conveying member 81 in the first conveying tube 95 (i.e., a direction pointing to the front side from the rear side) is deified as the first direction.

The toner thus scraped from the surface of the drum body 50 of each of the four photosensitive drums 11 is collected and is conveyed from the rear side to the front side in the first conveying tube 95.

Then, the toner conveyed to the front end part of the first conveying tube 95 flows into the communicating tube 103 of the second conveying part 92.

At this time, since the toner is conveyed frontward by the first conveying member 81, the toner contacts the rear surface of the closing part 93 and flows into the front end part of the third conveying tube 95 while moving to the lower right side along the inclined surface 104A in the second conveying tube 104 by its own weight.

Next, the toner flowed into the front end part of the third conveying tube 105 is conveyed to the rear side by the second conveying member 82. A direction in which the toner is conveyed by the second conveying member 82 in the third conveying tube 105 (i.e., a direction pointing to the rear side from the front side) is defined as the second direction.

As a result, the toner is conveyed to the discharging outlet 107 in the third conveying tube 105, and is discharged to the introducing tube 160 via the discharging outlet 107.

Then, the toner is stored in the waste toner storage unit 150 via the introducing tube 160.

Thus, the cleaning operation for the toner remaining on the surface of the drum body 50 is finished.

7. Advantageous Effects (1) As shown in FIGS. 8 and 9, according to the image forming apparatus 1, the toner remaining on the surface of the photosensitive drum 11 is scraped by the blade 76 of the cleaning member 61, is conveyed rightward by the cleaning conveying member 62, and flows into the conveying tube 80.

As shown in FIGS. 11A and 11B, the conveying tube 80 extends in the front and rear direction, and includes the first conveying tube 95 accommodating the first conveying member 81, and the second conveying tube 104 extending to the lower right side from the front end of the first conveying tube 95. Therefore, the toner is conveyed frontward in the first conveying tube 95, and is conveyed to the lower right side in the second conveying tube 104.

As a result, by only disposing the second conveying tube 104 to extend in the direction intersecting with the direction in which the first conveying tube 95 extends, the toner removed by the cleaning unit 30 can be conveyed to the discharging outlet 107 by the second conveying tube 104, and can be smoothly discharged to the waste toner storage unit 150.

(2) As shown in FIG. 9, according to the image forming apparatus 1, since the second conveying tube 104 communicates with the front end of the first conveying tube 95 via the communicating tube 103, the toner can be collected in the front end part of the toner conveying tube 95.

(3) As shown in FIG. 9, according to the image forming apparatus 1, since the conveying tube 80 includes the third conveying tube 105 which connects to the second conveying tube 104 and extends in the front and rear direction, the toner can be smoothly discharged by the waste toner storage unit 150.

(4) As shown in FIGS. 4C and 11B, according to the image forming apparatus 1, since the third conveying tube 105 includes the discharging outlet 107, the discharging outlet 107 can be securely disposed at a position away from the first conveying tube 95 in a high degree of design freedom.

Therefore, the toner being conveyed in the conveying tube 80 can be smoothly discharged by the waste toner storage unit 150.

(5) As shown in FIGS. 11A and 11B, according to the image forming apparatus 1, the toner can be discharged to the waste toner storage unit 150 by the third conveying tube 105 in a manner of avoiding the belt unit 5.

(6) As shown in FIG. 11B, according to the image forming apparatus 1, since the first conveying tube 95 is accommodated in the recessed part 147 of the frame 146 which supports the belt 17, it becomes possible to save the space and thereby to suppress increasing of the size of the image forming apparatus 1.

(7) As shown in FIGS. 10 and 11B, according to the image forming apparatus 1, the toner in the third conveying tube 105 can be securely conveyed to the rear side by the second conveying member 82.

As a result, it becomes possible to prevent the toner from staying in the conveying tube 80, and thereby it becomes possible to securely convey the toner to the discharging outlet 107.

(8) As shown in FIGS. 11A and 11B, according to the image forming apparatus 1, since the first axis A1 of the first conveying member 81 is disposed on the upper side of the second axis A2 of the second conveying member 82, it becomes possible to let the toner conveyed by the first conveying member 81 fall to the second conveying member 82 by its own weight.

As a result, it becomes possible to securely convey the toner to the waste toner storage unit 150 by the second conveying member 82 after being conveyed by the first conveying member 81.

(9) As shown in FIGS. 9 and 10, according to the image forming apparatus 1, since the second conveying member 82 is an auger screw, the toner can be securely conveyed in the third conveying tube 105.

(10) As shown in FIGS. 9 and 10, according to the image forming apparatus 1, since the first conveying member 81 is an auger screw, the toner can be securely conveyed in the first conveying tube 95.

(11) As shown in FIG. 11A, according to the image forming apparatus 1, since the second conveying tube 104 has the inclined surface 104A inclined downward, it becomes possible to convey the toner by its own weight from the first conveying tube 95 to the third conveying tube 105.

(12) As shown in FIG. 11B, according to the image forming apparatus 1, since the first positioning plate 28 can be disposed on an inner side in the left and right direction so that the first positioning plate 28 overlaps with the discharging outlet 107 when viewed in the up and down direction, the drum unit 9 can be downsized.

(13) As shown in FIG. 11B, according to the image forming apparatus 1, since the discharging outlet 107 is disposed on the lower side with respect to the first positioning plate 28, the toner can be discharged toward the waste toner storage unit 150 while avoiding the first positing plate 28.

(14) As shown in FIGS. 8 and 9, according to the drum unit 9, the toner remaining on the surface of the photosensitive drum 11 is collected by the cleaning member 61, and is conveyed rightward by the cleaning conveying member 62 and flows into the conveying tube 80.

As shown in FIGS. 11A and 11B, the conveying tube 80 extends in the front and rear direction, and includes the first conveying tube 95 accommodating the first conveying member 81, and the second conveying tube 104 extending to the lower right side from the front end part.

As a result, by only disposing the second conveying tube 104 to extend in the direction intersecting with the direction in which the first conveying tube 95 extends, the toner removed by the cleaning unit 30 can be conveyed to the discharging outlet 107 by the second conveying tube 104, and can be smoothly discharged to the waste toner storage unit 150.

(15) As shown in FIGS. 8 and 9, according to the image forming apparatus 1, the toner remaining on the surface of the photosensitive drum 11 is removed by the cleaning unit 30 and flows into the conveying tube 80 of the conveying unit 31.

Then, as shown in FIGS. 9 and 10, the toner is conveyed frontward by the first conveying member 81 disposed in the conveying tube 80, and thereafter is conveyed rearward by the second conveying member 82.

Therefore, the direction in which the toner is conveyed can be switched in the conveying tube 80.

As a result, a degree of freedom regarding conveying of toner can be enhanced, and the toner can be securely conveyed to the waste toner storage unit 150.

(16) As shown in FIGS. 9 and 11A, according to the image forming apparatus 1, the second conveying tube 104 is connected to the first conveying tube 95 accommodating the first conveying member 81 extending in the front and rear direction, and extends to the lower right side from the front end part of the first conveying tube 95.

Therefore, by conveying the toner from the first conveying tube 95 to the second conveying tube 104, the direction in which the toner is conveyed can be switched.

As a result, a degree of freedom regarding conveying of toner can be enhanced and thereby the toner can be conveyed to the waste toner storage unit 150 more securely.

(17) As shown in FIG. 9, according to the image forming apparatus 1, the conveying tube 80 includes the third conveying tube 105 connected to the first conveying tube 95 via the second conveying tube 104, and the third conveying tube 105 accommodates the second conveying member 82.

Therefore, the toner in the conveying tube 80 can be conveyed in the first conveying tube 95, the second conveying tube 104 and the third conveying tube 105 in this order, and in the first conveying tube 95, the toner is conveyed by the first conveying member 81, and in the third conveying tube 105, the toner is conveyed to the second conveying member 82.

As a result, a degree of freedom regarding conveying of toner can be enhanced, and thereby the toner can be conveyed to the waste toner storage unit 150 more securely.

(18) As shown in FIGS. 9 and 11B, according to the image forming apparatus 1, since the third conveying tube 105 has the discharging outlet 107, it becomes possible to discharge the toner to the waste toner storage unit 150 from the third conveying tube 105 disposed at the position different from the first conveying tube 95.

(19) As shown in FIGS. 5A and 5B, according to the image forming apparatus 1, the discharging outlet 107 can be closed or opened by a simple structure in which the shutter 130 is moved along the circumferential surface of the third conveying tube 105.

(20) As shown in FIGS. 4C and 9, according to the image forming apparatus 1, since the second conveying tube 104 connects the front end part of the first conveying tube 95 and the front end part of the third conveying tube 105, the toner can be conveyed such that the conveying direction of the toner can be switched by 180 degrees from the first conveying tube 95 to the third conveying tube 105.

(21) As shown in FIG. 4B, according to the image forming apparatus 1, by enhancing a degree of freedom regarding disposing of the second conveying tube 104 while securely positioning the first conveying tube 95 by the first positioning plate 28, the toner in the conveying tube 80 can be smoothly conveyed to the waste toner storage unit 150.

(22) According to the image forming apparatus 1, the first conveying tube 95 is screwed to the frame 60 of the cleaning unit 30 via the fixing hole 101.

Therefore, as shown in FIGS. 8 and 9, it becomes possible to stably convey the toner which is scraped from the surface of the photosensitive drum 11 by the blade 76 of the cleaning unit 30 and is conveyed in the frame 60 by the cleaning unit 62, to the first conveying tube 95.

(23) As shown in FIGS. 9 and 10, according to the image forming apparatus 1, since the first conveying member 81 is an auger screw, the toner can be securely conveyed to the front side in the conveying tube 80.

(24) As shown in FIGS. 9 and 10, according to the image forming apparatus 1, since the second conveying member 82 is an auger screw, the toner can be securely conveyed to the rear side in the conveying tube 80.

(25) As shown in FIG. 10, according to the image forming apparatus 1, the first conveying member 81 rotates by inputting a driving force to the first gear 84, and the second conveying member 82 rotates by inputting a driving force to the second gear 85.

Therefore, as shown in FIGS. 4C and 10, since the first gear 84 engages with the second gear 85, it is possible to rotate both of the first conveying member 81 and the second conveying member 82 by inputting a driving force to the second gear 85.

As a result, since there is no necessity to provide individual driving sources respectively for rotating the first conveying member 81 and the second conveying member 82, the number of components can be reduced.

(26) As shown in FIGS. 9 and 10, according to the image forming apparatus 1, since the first conveying member 81 and the second conveying member 82 are parallel with each other, it becomes possible to easily convey the toner by the second conveying member 82 in the direction opposite to the direction in which the first conveying member 81 conveys the toner.

(27) As shown in FIGS. 9 and 10, according to the image forming apparatus 1, by setting the size of the second conveying member 82 in the front and rear direction to be shorter than the size of the first conveying member 81 in the front and rear direction, it becomes possible to suppress increasing of the size of the conveying unit 31 while enhancing a degree of freedom regarding conveying of toner.

(28) As shown in FIGS. 8 and 9, according to the drum unit 9, the toner remaining on the surface of the photosensitive drum 11 is removed from the cleaning unit 30 and flows into the conveying tube 80.

The toner removed from all the photosensitive drums 11 are collected by the first conveying member 81 disposed in the conveying tube 80, and is conveyed rearward by the second conveying member 82 after being conveyed frontward.

Therefore, the conveying direction of the collected toner can be switched in the conveying tube 80.

As a result, a degree of freedom regarding conveying of toner can be enhanced, and the toner can be securely conveyed to the waste toner storage unit 150.

What is claimed is:

1. An image forming apparatus, comprising:

a body casing;

a drum unit configured to move between an inside position in the body casing and an outside position which is outside the body casing; and a waste toner storage unit configured to store toner, the drum unit comprising:

a photosensitive drum;

a cleaning unit configured to remove toner remaining on a surface of the photosensitive drum; and a conveying unit configured to convey the toner removed by the cleaning unit, wherein the waste toner storage unit is configured to store the toner conveyed by the conveying unit, wherein the conveying unit comprises:

a conveying member configured to convey the toner removed by the cleaning unit in a moving direction of the drum unit; and a conveying tube accommodating the conveying member, the conveying tube having a discharging outlet through which the toner carried by the conveying member is discharged to the waste toner storage unit, and wherein the conveying tube comprises:

a first conveying tube extending in the moving direction of the drum unit and accommodating the conveying member; and a second conveying tube connected to the first conveying tube and extending in a direction intersecting with a direction in which the first conveying tube extends.

2. The image forming apparatus according to claim 1, wherein the second conveying tube is connected to an end part of the first conveying tube in the moving direction of the drum unit.

3. The image forming apparatus according to claim 1, wherein the conveying tube further comprises a third conveying tube connected to the second conveying tube and extending in the direction in which the first conveying tube extends.

4. The image forming apparatus according to claim 3, wherein the third conveying tube has the discharging outlet.

5. The image forming apparatus according to claim 3, further comprising a belt unit having a belt contacting the photosensitive drum when the drum unit is disposed at the inside position, wherein:

at least a part of the first conveying tube overlaps with the belt unit when viewed in a direction in which the photosensitive drum and the belt overlap with each other; and the third conveying tube not to overlap with the belt unit when viewed in the direction in which the photosensitive drum and the belt overlap with each other.

6. The image forming apparatus according to claim 5, wherein:

the belt unit comprises a frame supporting the belt; and the frame comprises a recessed part accommodating the first conveying tube.

7. The image forming apparatus according to claim 3, further comprising an additional conveying member disposed in the third conveying tube, the additional conveying member being configured to convey, in the moving direction of the drum unit, the toner conveyed by the conveying member.

8. The image forming apparatus according to claim 7, wherein:

each of the conveying member and the additional conveying member is rotatable; and a rotation axis of the conveying member is disposed on an upper side with respect to a rotation axis of the additional conveying member.

9. The image forming apparatus according to claim 7, wherein the additional conveying member is an auger screw.

10. The image forming apparatus according to claim 1, wherein the conveying member is an auger screw.

11. The image forming apparatus according to claim 1, wherein the second conveying tube has an inclined surface inclined downward and toward a direction separating from the first conveying tube.

12. The image forming apparatus according to claim 1, wherein:

the drum unit has a positioning plate positioning the photosensitive drum; and at least a part of the positioning plate overlaps with the discharging outlet when viewed in an up and down direction.

13. The image forming apparatus according to claim 1, wherein:

the drum unit has a positioning plate positioning the photosensitive drum; and the positioning plate is disposed on an inner side with respect to the discharging outlet in an axis direction of the photosensitive drum.

14. The image forming apparatus according to claim 12, wherein the discharging outlet is disposed on a lower side with respect to the positioning plate in the up and down direction.

15. A drum unit, comprising:

a first photosensitive drum;

a second photosensitive drum;

a first cleaning unit configured to remove toner remaining on a surface of the first photosensitive drum;

a second cleaning unit configured to remove toner remaining on a surface of the second photosensitive drum; and a conveying unit configured to convey toner removed by the first cleaning unit and the second cleaning unit, the conveying unit comprising:

a conveying member configured to convey the toner removed by the first cleaning unit and the second cleaning unit in an arranging direction in which the first photosensitive drum and the second photosensitive drum are arranged; and a conveying tube accommodating the conveying member, the conveying tube having a discharging outlet through which the toner carried by the conveying member is discharged to an outside, and the conveying tube comprising:

a first conveying tube extending in the arranging direction and accommodating the conveying member; and a second conveying tube connected to the first conveying tube and extending in a direction intersecting with a direction in which the first conveying tube extends.

16. The drum unit according to claim 15, wherein the second conveying tube is connected to an end part of the first conveying tube in the arranging direction.

17. The drum unit according to claim 15, wherein the conveying tube further comprises a third conveying tube connected to the second conveying tube and extending in the direction in which the first conveying tube extends.

18. The drum unit according to claim 17, wherein the third conveying tube has the discharging outlet.

19. The drum unit according to claim 17, further comprising an additional conveying member disposed in the third conveying tube, the additional conveying member being configured to convey, in the arranging direction, the toner conveyed by the conveying member.

20. The drum unit according to claim 19, wherein:

each of the conveying member and the additional conveying member is rotatable; and a position of a rotation axis of the conveying member is different from a position of a rotation axis of the additional conveying member in a direction perpendicular to both of the arranging direction and an axis direction of each of the first photosensitive drum and the second photosensitive drum.

21. The drum unit according to claim 19, wherein the additional conveying member is an auger screw.

22. The drum unit according to claim 15, wherein the conveying member is an auger screw.

23. The drum unit according to claim 15, wherein the second conveying tube has an inclined surface.

24. The drum unit according to claim 15, further comprising a positioning plate positioning the first photosensitive drum and the second photosensitive drum, wherein at least a part of the positioning plate overlaps with the discharging outlet when viewed in a direction perpendicular to both of the arranging direction and an axis direction of each of the first photosensitive drum and the second photosensitive drum.

25. The drum unit according to claim 15, further comprising a positioning plate positioning the first photosensitive drum and the second photosensitive drum, wherein the positioning plate is disposed on an inner side with respect to the discharging outlet in an axis direction of each of the first photosensitive drum and the second photosensitive drum.

26. An image forming apparatus, comprising:

a body casing;

a drum unit configured to move between an inside position in the body casing and an outside position which is outside the body casing; and a waste toner storage unit configured to store toner, the drum unit comprising:

a photosensitive drum;

a cleaning unit configured to remove toner remaining on a surface of the photosensitive drum; and a conveying unit configured to convey the toner removed by the cleaning unit, wherein the waste toner storage unit is configured to store the toner conveyed by the conveying unit, wherein the conveying unit comprises:

a first conveying member configured to rotate about a first axis extending in a moving direction of the drum unit and to convey the toner removed by the cleaning unit in a first direction along the moving direction;

a second conveying member configured to rotate about a second axis extending in the moving direction of the drum unit and to convey the toner conveyed by the first conveying member in a second direction opposite to the first direction; and a conveying tube accommodating the first conveying member and the second conveying member, the conveying tube having a discharging outlet through which the toner conveyed by the first conveying member and the second conveying member is discharged to the waste toner storage unit.

27. The image forming apparatus according to claim 26, wherein the conveying tube comprises:

a first conveying tube accommodating the first conveying member; and a second conveying tube connecting to the first conveying tube and extending in a direction intersecting with the moving direction of the drum unit.

28. The image forming apparatus according to claim 27, wherein:

the conveying tube further comprises a third conveying tube accommodating the second conveying member; and the second conveying tube connecting the first conveying tube and the third conveying tube.

29. The image forming apparatus according to claim 28, wherein the third conveying tube has the discharging outlet.

30. The image forming apparatus according to claim 29, wherein:

the third conveying tube has a cylindrical shape extending in the moving direction of the drum unit; and the conveying unit comprises a shutter configured to move, along a circumferential surface of the third conveying tube, between a closing position where the shutter closes the discharging outlet and a releasing position where the shutter releases the discharging outlet.

31. The image forming apparatus according to claim 28, wherein the second conveying tube connects a most downstream part of the first conveying tube in the first direction to a most upstream part of the third conveying tube in the second direction.

32. The image forming apparatus according to claim 27, wherein:

the drum unit comprises a positioning plate positioning the photosensitive drum; and the first conveying tube is fixed to the positioning plate.

33. The image forming apparatus according to claim 27, wherein the cleaning unit comprises:

a frame;

a blade contacting the photosensitive drum; and a cleaning conveying member disposed in the frame, and wherein the first conveying tube has a fixing hole for screwing to the frame.

34. The image forming apparatus according to claim 26, wherein the first conveying member is an auger screw.

35. The image forming apparatus according to claim 26, wherein the second conveying member is an auger screw.

36. The image forming apparatus according to claim 26, wherein the conveying unit comprises:

a first gear fixed to the first conveying member and rotatable together with the first conveying member; and a second gear fixed to the second conveying member and rotatable together with the second conveying member, the second gear engaging with the first gear.

37. The image forming apparatus according to claim 26, wherein the first conveying member and the second conveying member are disposed to be parallel with each other.

38. The image forming apparatus according to claim 37, wherein a size of the second conveying member in the moving direction of the drum unit is shorter than a size of the first conveying member in the moving direction of the drum unit.

39. A drum unit, comprising:

a first photosensitive drum;

a second photosensitive drum;

a first cleaning unit configured to remove toner remaining on a surface of the first photosensitive drum;

a second cleaning unit configured to remove toner remaining on a surface of the second photosensitive drum; and a conveying unit configured to convey toner removed by the first cleaning unit and the second cleaning unit, wherein the conveying unit comprises:

a first conveying member configured to rotate about a first axis extending in an arranging direction in which the first photosensitive drum and the second photosensitive drum are arranged and to convey the toner removed by the first cleaning unit and the second cleaning unit in a first direction along the arranging direction;

a second conveying member configured to rotate about a second axis extending in the arranging direction and to convey the toner conveyed by the first conveying member in a second direction opposite to the first direction; and a conveying tube accommodating the first conveying member and the second conveying member, the conveying tube having a discharging outlet through which the toner conveyed by the first conveying member and the second conveying member is discharged to an outside.

40. The drum unit according to claim 39, wherein the conveying tube comprises:

a first conveying tube accommodating the first conveying member; and a second conveying tube connected to the first conveying tube and extending in a direction intersecting with the arranging direction.

41. The drum unit according to claim 40, wherein:

the conveying tube further comprises a third conveying tube accommodating the second conveying member; and the second conveying tube connecting the first conveying tube and the third conveying tube.

42. The drum unit according to claim 41, wherein the third conveying tube has the discharging outlet.

43. The drum unit according to claim 42, wherein:

the third conveying tube has a cylindrical shape extending in the arranging direction; and the conveying unit comprises a shutter configured to move, along a circumferential surface of the third conveying tube, between a closing position where the shutter closes the discharging outlet and a releasing position where the shutter releases the discharging outlet.

44. The drum unit according to claim 41, wherein the second conveying tube connects a most downstream part of the first conveying tube in the first direction to a most upstream part of the third conveying tube in the second direction.

45. The drum unit according to claim 40, further comprising a positioning plate positioning the first photosensitive drum and the second photosensitive drum; and the first conveying tube is fixed to the positioning plate.

46. The drum unit according to claim 40, wherein the first cleaning unit comprises:

a first frame;

a first blade contacting the first photosensitive drum; and a first cleaning conveying member disposed in the first frame, wherein the second cleaning unit comprises:

a second frame;

a second blade contacting the second photosensitive drum; and a second cleaning conveying member disposed in the second frame, and wherein the first conveying tube comprises:

a first fixing hole for screwing to the first frame; and a second fixing hole for screwing to the second frame.

47. The drum unit according to claim 39, wherein the first conveying member is an auger screw.

48. The drum unit according to claim 39, wherein the second conveying member is an auger screw.

49. The drum unit according to claim 39, wherein the conveying unit comprises:

a first gear fixed to the first conveying member and rotatable together with the first conveying member; and a second gear fixed to the second conveying member and rotatable together with the second conveying member, the second gear engaging with the first gear.

50. The drum unit according to claim 39, wherein the first conveying member and the second conveying member are disposed to be parallel with each other.

51. The drum unit according to claim 50, wherein a size of the second conveying member in the arranging direction is shorter than a size of the first conveying member in the arranging direction.

* * * * *